US010716974B2

(12) United States Patent
Mizutani

(10) Patent No.: US 10,716,974 B2
(45) Date of Patent: Jul. 21, 2020

(54) GOLF CLUB HEAD

(71) Applicant: Sumitomo Rubber Industries, Ltd., Hyogo (JP)

(72) Inventor: Naruhiro Mizutani, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/270,439

(22) Filed: Feb. 7, 2019

(65) Prior Publication Data

US 2019/0255393 A1 Aug. 22, 2019

(30) Foreign Application Priority Data

Feb. 19, 2018 (JP) ..... 2018-26888

(51) Int. Cl.
*A63B 53/04* (2015.01)
*A63B 102/32* (2015.01)

(52) U.S. Cl.
CPC ..... *A63B 53/04* (2013.01); *A63B 53/047* (2013.01); *A63B 53/0466* (2013.01); *A63B 53/0487* (2013.01); *A63B 2053/045* (2013.01); *A63B 2053/0437* (2013.01); *A63B 2102/32* (2015.10); *A63B 2209/02* (2013.01)

(58) Field of Classification Search
CPC ... A63B 53/04; A63B 53/0466; A63B 53/047; A63B 2102/32; A63B 2053/045; A63B 2053/0437; A63B 53/0487
USPC ..... 473/324–350, 287–292
See application file for complete search history.

(56) References Cited

U.S. PATENT DOCUMENTS 5,080,366 A * 1/1992 Okumoto ..... A63B 53/04 473/348
5,261,664 A * 11/1993 Anderson ..... A63B 53/04 473/342
5,294,037 A * 3/1994 Schmidt ..... A63B 53/04 228/125
5,993,329 A * 11/1999 Shieh ..... A63B 53/04 473/329
6,050,904 A * 4/2000 Kuo ..... A63B 53/04 473/342
6,299,549 B1 * 10/2001 Shieh ..... A63B 53/04 473/342
6,319,149 B1 * 11/2001 Lee ..... A63B 53/04 473/342
6,832,961 B2 * 12/2004 Sano ..... A63B 53/0466 473/324
7,273,423 B2 * 9/2007 Imamoto ..... A63B 53/0466 473/332
7,390,271 B2 * 6/2008 Yamamoto ..... A63B 53/0466 473/345
7,575,525 B2 * 8/2009 Matsunaga ..... A63B 53/0466 473/342

(Continued)

*Primary Examiner* — Sebastiano Passaniti
(74) *Attorney, Agent, or Firm* — Studebaker & Brackett PC

(57) ABSTRACT

A golf club head includes a hollow portion. The head includes a first member having an opening, and a second member attached to the first member and covering the opening. The first member includes a first rib projected toward the hollow portion. The second member includes a second rib projected toward the hollow portion. The first rib is engaged with the second rib. A Young's modulus of a material of the second member may be smaller than that of the first member. The second member may be adhered to the first member using an adhesive.

15 Claims, 18 Drawing Sheets

(56) References Cited

U.S. PATENT DOCUMENTS

| | | | | |
|---|---|---|---|---|
| 7,749,104 | B2 * | 7/2010 | Brekke | A63B 53/0466 473/345 |
| 7,758,453 | B2 * | 7/2010 | Horacek | A63B 53/0466 473/345 |
| 7,775,907 | B2 * | 8/2010 | Hirano | A63B 53/0466 473/345 |
| 8,206,241 | B2 * | 6/2012 | Boyd | A63B 53/0466 473/332 |
| 8,226,500 | B2 * | 7/2012 | Yamamoto | A63B 53/0466 473/332 |
| 8,657,703 | B2 * | 2/2014 | Wada | A63B 53/0466 473/335 |
| 8,678,949 | B2 * | 3/2014 | Shimazaki | A63B 53/0466 473/345 |
| 8,858,363 | B2 * | 10/2014 | Wada | A63B 53/0466 473/346 |
| 2002/0108735 | A1 * | 8/2002 | Kuo | A63B 53/0466 164/107 |
| 2003/0207726 | A1 * | 11/2003 | Lee | A63B 53/04 473/342 |
| 2006/0105856 | A1 * | 5/2006 | Lo | A63B 53/04 473/334 |
| 2009/0093321 | A1 * | 4/2009 | Hsu | A63B 53/466 473/343 |
| 2011/0118051 | A1 * | 5/2011 | Thomas | A63B 53/0466 473/328 |
| 2012/0302369 | A1 * | 11/2012 | Ban | A63B 53/04 473/346 |
| 2013/0109503 | A1 | 5/2013 | Matsunaga | |
| 2015/0290504 | A1 * | 10/2015 | Li | A63B 53/0466 473/346 |

* cited by examiner

GOLF CLUB HEAD

The present application claims priority on Patent Application No. 2018-026888 filed in JAPAN on Feb. 19, 2018. The entire contents of this Japanese Patent Application are hereby incorporated by reference.

BACKGROUND OF THE INVENTION

Field of the Invention

The present disclosure relates to a golf club head.

Description of the Related Art

There has been proposed a head having a rib projected toward a hollow portion side. Japanese patent No. 5902912 (US2013/0109503) discloses a head in which at least a part of a crown is formed by a resin member composed of a fiber reinforced resin. This resin member includes a rib projected toward a hollow portion side.

SUMMARY OF THE INVENTION

Materials can be selected for respective members in a head including a body having an opening and a lid member disposed so as to close the opening. Therefore, such a head is excellent in degree of freedom of design. However, the rigidity of the head is likely to be reduced due to the presence of the opening. When the rigidity of the lid member is not high, the rigidity of the head can be further reduced. In addition, there is a possibility of further reducing the rigidity of the head depending on a joining method of the body and the lid member. Such a reduced head rigidity lowers the hitting sound.

The present disclosure relates to a structure of improving the rigidity of a head in which an opening is covered by another member.

In one aspect, a golf club head includes a hollow portion, a first member having an opening, and a second member attached to the first member and covering the opening. The first member includes a first rib projected toward the hollow portion. The second member includes a second rib projected toward the hollow portion. The first rib is engaged with the second rib.

DESCRIPTION OF THE PREFERRED EMBODIMENTS

The following will describe embodiments in detail with appropriate reference to the drawings.

Figure 1:
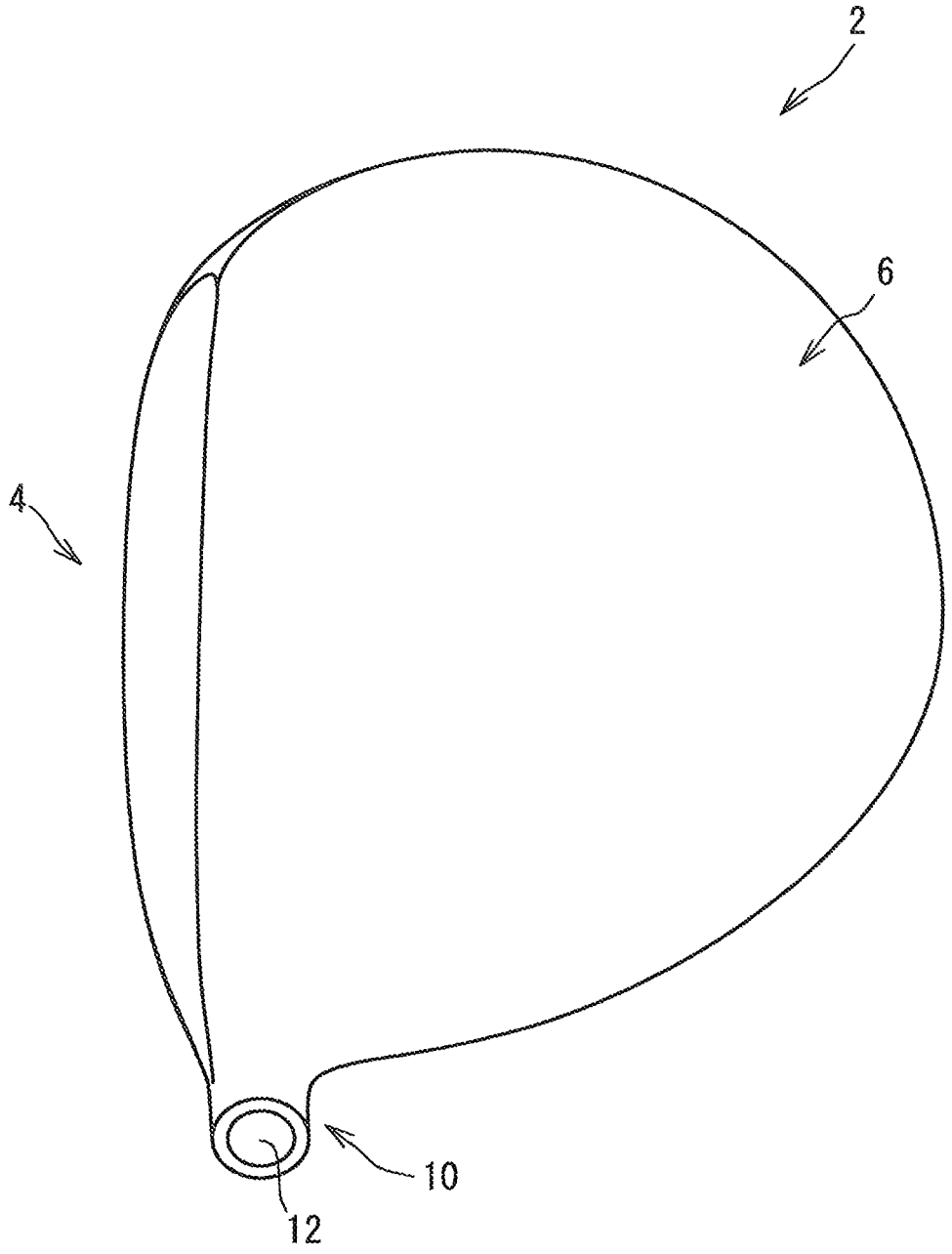
FIG. 1 is a plan view of a golf club head according to a first embodiment.
Figure 2:
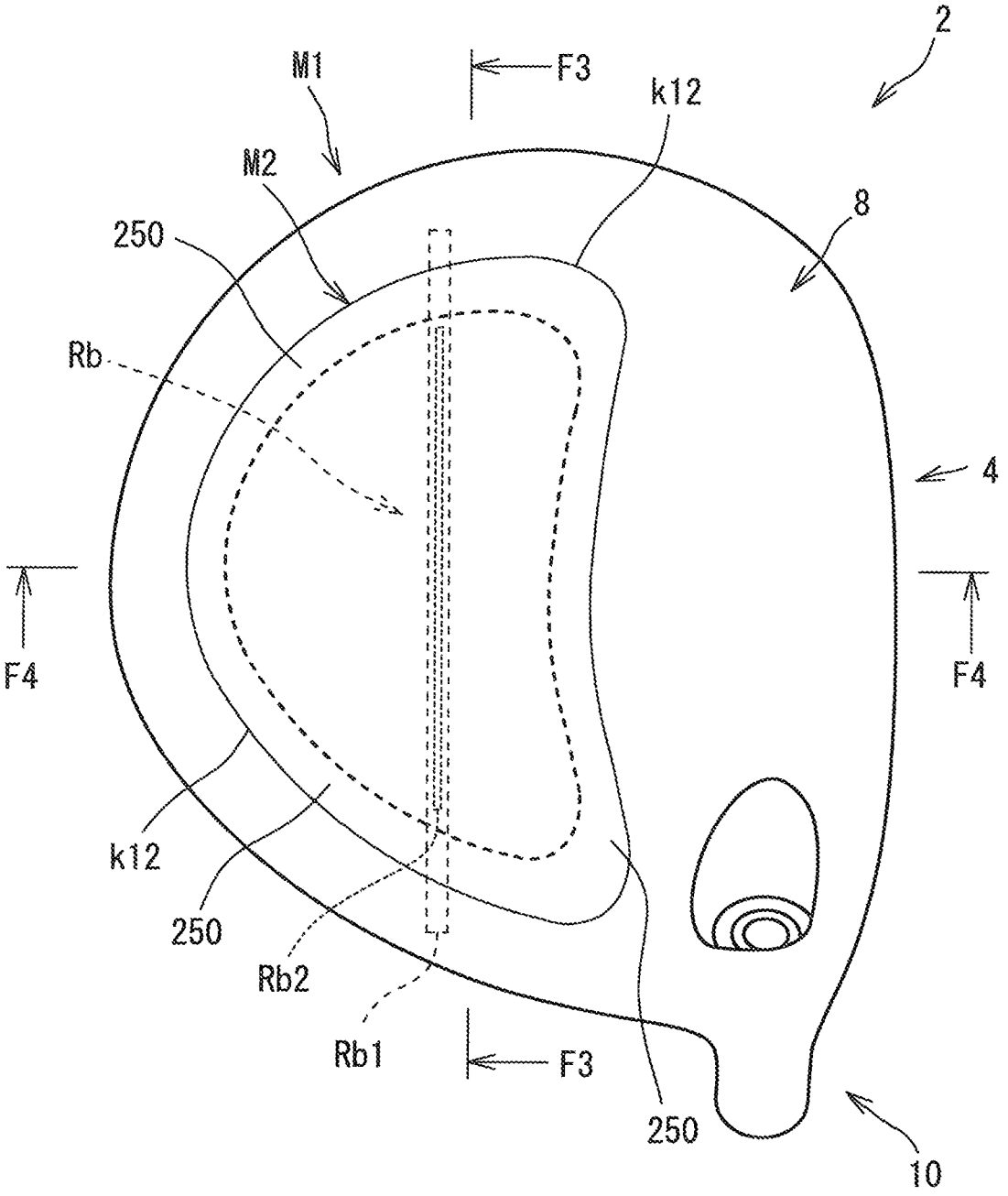
FIG. 2 is a bottom view of the head in FIG. 1.
Figure 3:
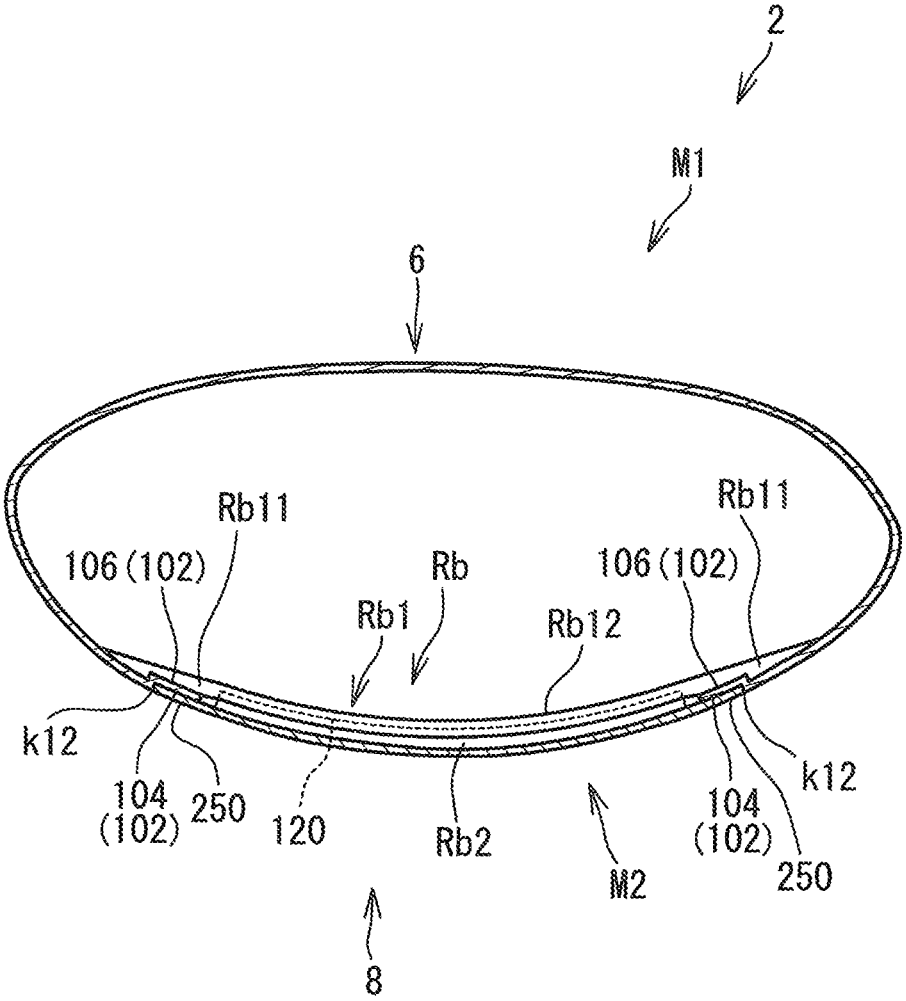
FIG. 3 is a cross-sectional view taken along line F3-F3 in FIG. 2.
Figure 4:
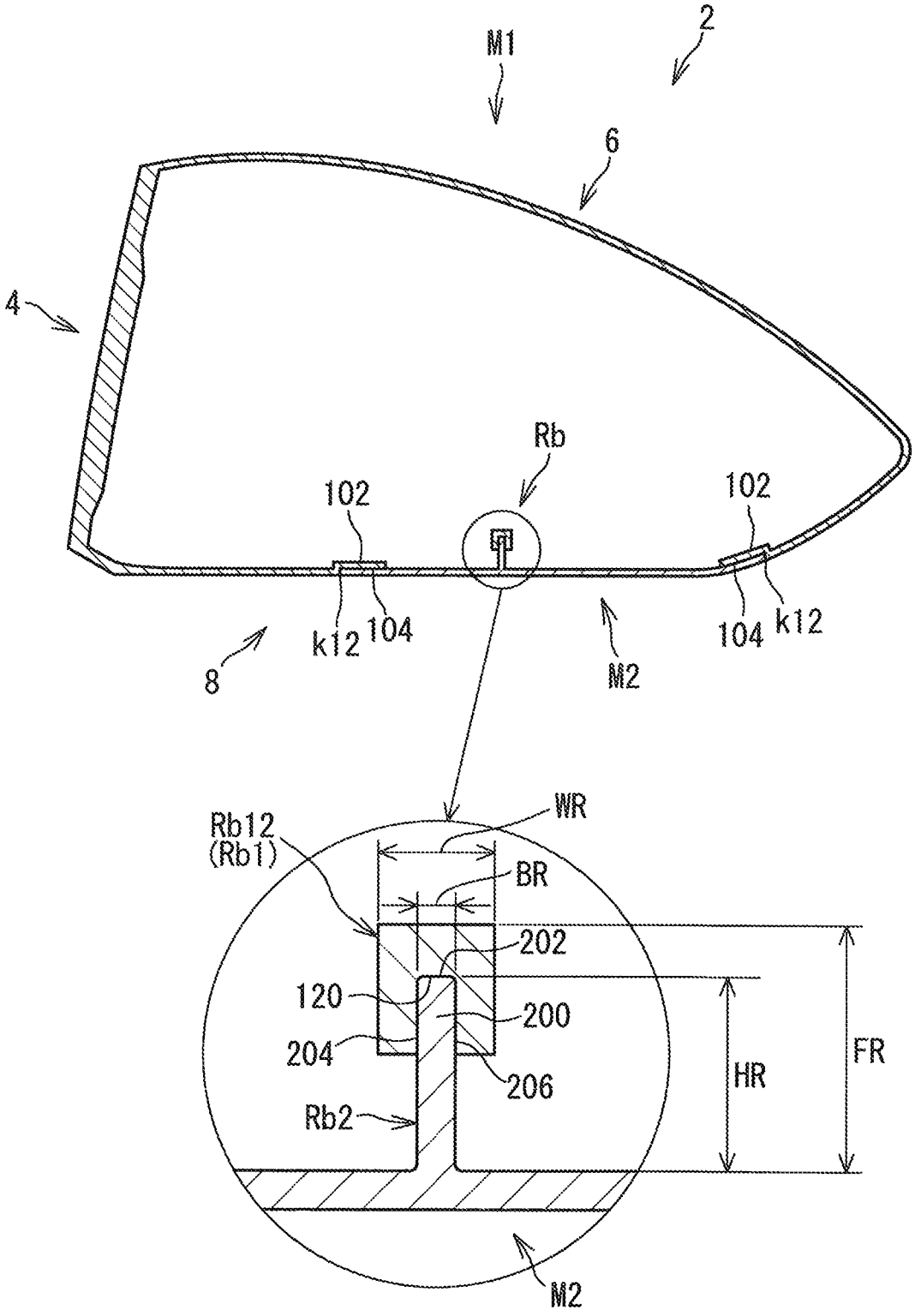
FIG. 4 is a cross-sectional view taken along line F4-F4 in FIG. 2.

FIG. 1 is a plan view of a head 2 according to a first embodiment as viewed from a crown side. FIG. 2 is a bottom view of the head 2 as viewed from a sole side. FIG. 3 is a cross-sectional view taken along line F3-F3 in FIG. 2. FIG. 4 is a cross-sectional view taken along line F4-F4 in FIG. 2.

The head 2 includes a hitting face 4, a crown 6, a sole 8, and a hosel 10. The hosel 10 includes a hosel hole 12. A shaft having a sleeve fixed to a tip end portion of the shaft is detachably fixed to the hosel hole 12.

As shown in FIG. 3 and FIG. 4, the head 2 is hollow. That is, the head 2 includes a hollow portion.

The head 2 is a driver head. The head 2 is a wood type head. The type of the head 2 is not limited. Examples of the type of the head 2 include a wood type head, a hybrid type head, an iron type head, and a putter type head.

The head 2 includes a rib Rb. As described later, the rib Rb is formed by a plurality of ribs being composited. In this respect, the rib Rb is also referred to as a composite rib. The composite rib Rb is provided on the inner surface of the sole 8. The position of the composite rib Rb is not limited. For example, the composite rib Rb may be provided on the inner surface of the crown 6. For example, the composite rib Rb may continuously extend from the inner surface of the crown 6 to the inner surface of the sole 8.

Figure 5:
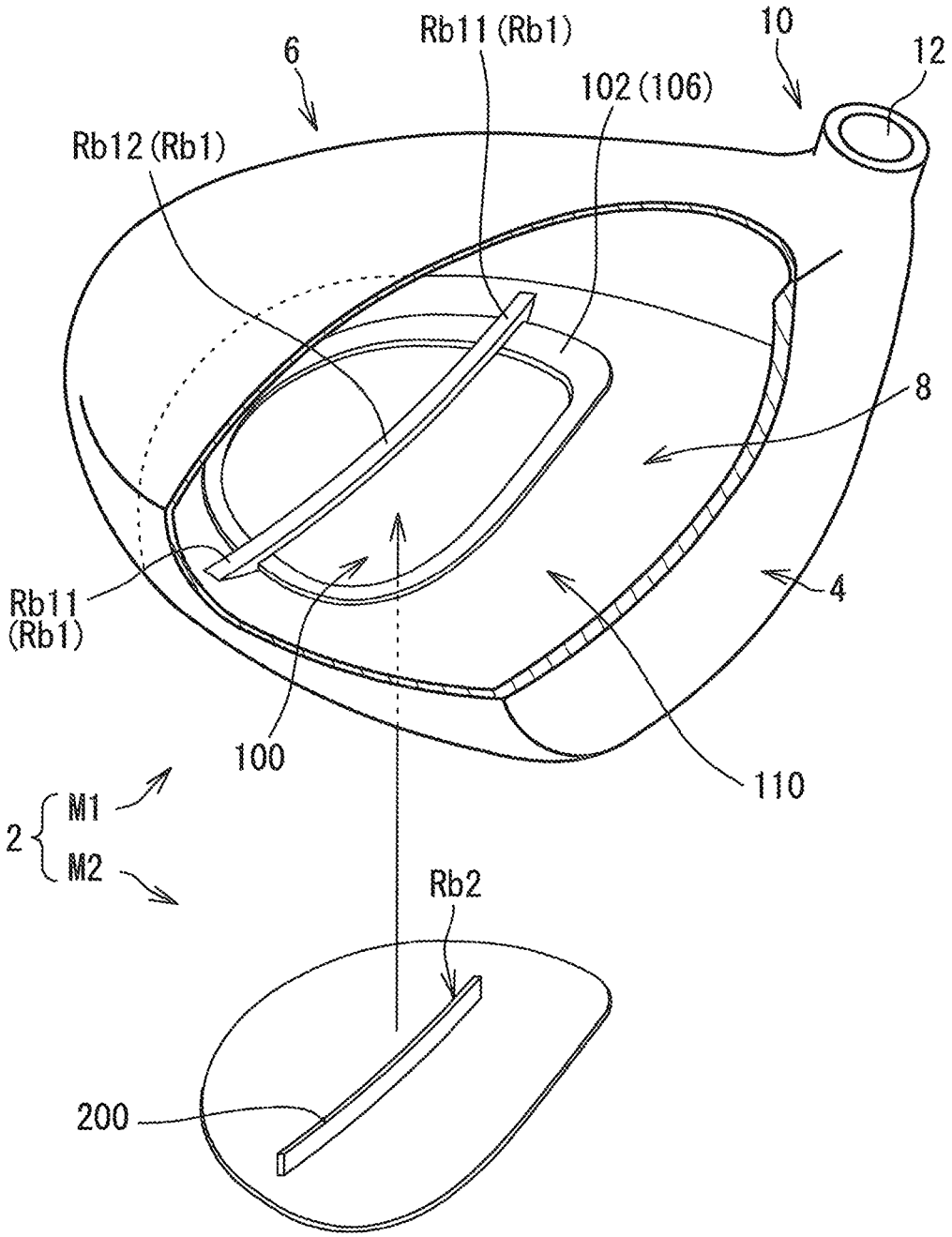
FIG. 5 is an exploded perspective view of the head in FIG. 1.
Figure 6:
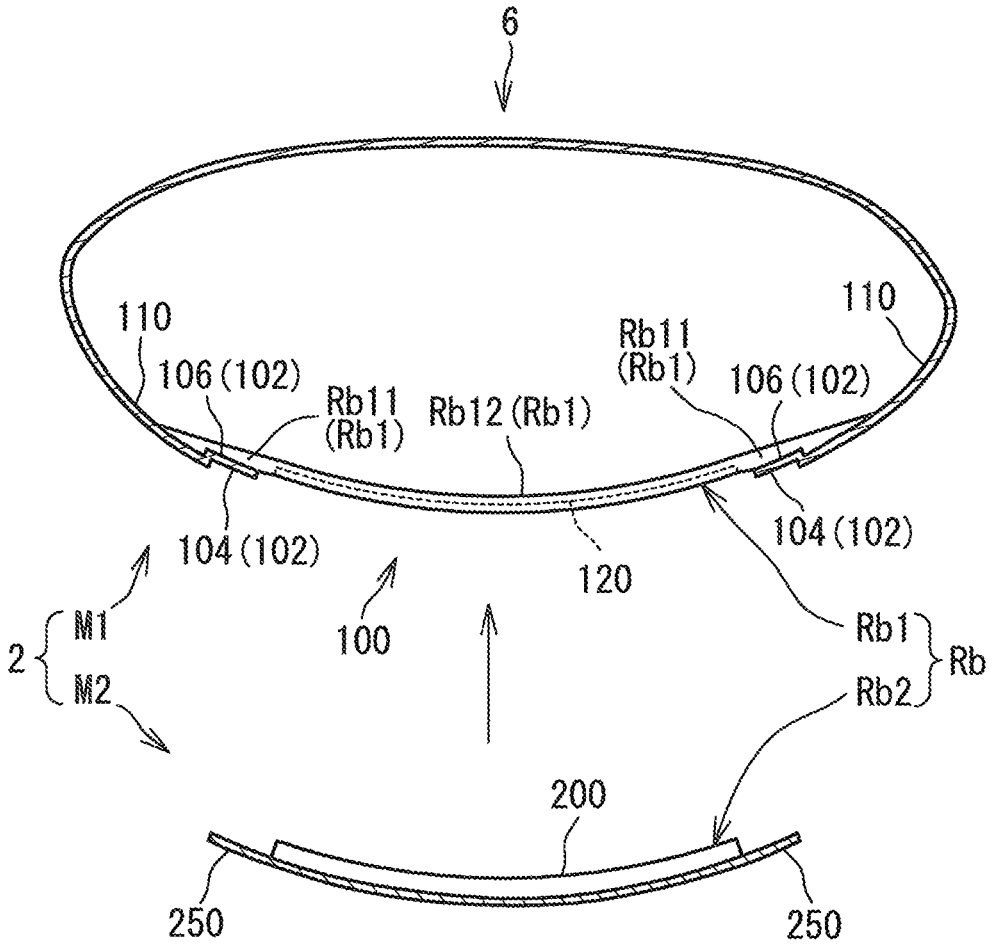
FIG. 6 is an exploded cross-sectional view of the head in FIG. 1.
Figure 7:
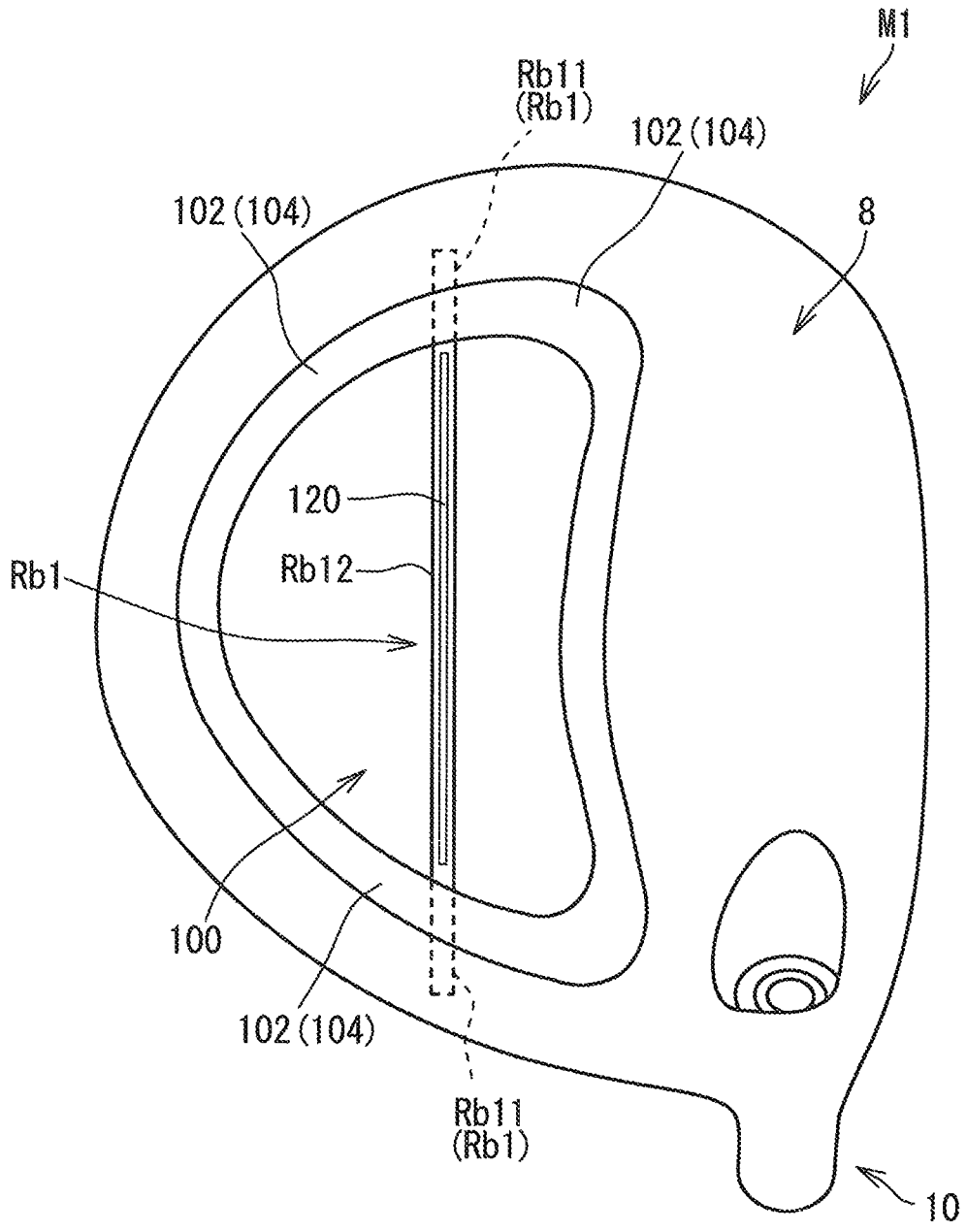
FIG. 7 is a bottom view of a first member of the head in FIG. 1.

FIG. 5 is an exploded perspective view of the head 2. In the perspective view of the head in FIG. 5, a part of the head 2 is removed. FIG. 6 is an exploded cross-sectional view of the head 2. FIG. 7 is a bottom view of a first member M1 as viewed from the sole side.

The head 2 is formed by joining a plurality of members to each other. As shown in FIG. 5 and FIG. 6, the head 2 includes the first member M1 and a second member M2. The second member M2 constitutes a part of the sole 8. The sole 8 is constituted by only the first member M1 and the second member M2. The head 2 is constituted by only the first member M1 and the second member M2. The head 2 may further include a third member. The head 2 may be constituted by three or more members. The first member M1 may be formed by joining a plurality of members to each other, and the second member M2 may be formed by joining a plurality of members to each other.

The second member M2 is joined to the first member M1. The method for this joining is adhesion with an adhesive. The joining method is not limited. Examples of the joining method include adhesion with an adhesive, brazing, welding, fitting, and combinations of those.

The first member M1 is a body of the head 2. The first member M1 constitutes at least a part of the crown 6. In the present embodiment, the first member M1 constitutes the whole crown 6. The first member M1 constitutes at least a part of the hitting face 4. In the present embodiment, the first member M1 constitutes the whole hitting face 4. The first member M1 constitutes at least a part of the sole 8. In the present embodiment, the first member M1 constitutes a part of the sole 8. The first member M1 constitutes at least apart of the hosel 10. In the present embodiment, the first member M1 constitutes the whole hosel 10. The structure of the first member M1 is not limited. For example, the first member M1 may be formed by joining a cup face including the hitting face 4 to another part.

The first member M1 includes an opening 100. The opening 100 is provided in the sole 8. The opening 100 penetrates the sole 8. The opening 100 connects the hollow portion and the outside of the head 2. The position of the opening 100 is not limited. The opening 100 may be provided in the crown 6. The opening 100 may be provided in a side portion (skirt portion) of the head. The opening 100 may be provided in a region extending from the crown 6 to the sole 8.

As well shown in FIG. 5 and FIG. 7, the first member M1 includes a support portion 102. The support portion 102 is formed on the circumference of the opening 100. The support portion 102 surrounds the opening 100. The support portion 102 need not surround the opening 100. The support portion 102 may be provided partially on the circumference of the opening 100.

As well shown in FIG. 6, the support portion 102 forms a stepped-down portion 104 on the outer surface of the first member M1. In the present embodiment, the support portion 102 forms the stepped-down portion 104 on the outer surface of the sole 8. The stepped-down portion 104 has an outline shape corresponding to that of the second member M2. A peripheral edge portion 250 of the second member M2 is disposed on the stepped-down portion 104 (see FIG. 3). The stepped-down portion 104 has a depth corresponding to the thickness of the peripheral edge portion 250 of the second member M2. On the outer surface of the head 2, no step is present at a boundary k12 between the first member M1 and the second member M2.

As well shown in FIG. 5, the support portion 102 forms a stepped-up portion 106 on the inner surface of the first member M1. In the present embodiment, the support portion 102 forms the stepped-up portion 106 on the inner surface of the sole 8. The depth of the stepped-down portion 104 is equal to the height of the stepped-up portion 106. Of course, the depth of the stepped-down portion 104 need not be equal to the height of the stepped-up portion 106. The support portion 102 may have a wall thickness equal to that of the sole 8 in a portion adjacent to the support portion 102, or may have a wall thickness different from that of the sole 8 in the portion adjacent to the support portion 102. For example, the wall thickness of the support portion 102 may be greater than the wall thickness of the sole 8 in the portion adjacent of the support portion 102.

As well shown in FIG. 5 and FIG. 6, the first member M1 includes the support portion 102 and a body portion 110 constituting the circumference of the support portion 102. The body portion 110 constitutes at least a portion adjacent to the support portion 102. In the present embodiment, of the first member M1, a portion excluding the support portion 102 is constituted by the body portion 110.

The first member M1 includes a first rib Rb1. The first rib Rb1 includes a base portion Rb11 and an opening extension portion Rb12. The base portion Rb11 is projected upward from the inner surface of the first member M1. Of the first rib Rb1, a portion located on the upper side of the inner surface of the first member M1 is the base portion Rb11. Of the first rib Rb1, a portion located on the upper side of the opening 100 is the opening extension portion Rb12. The opening extension portion Rb12 extends from the base portion Rb11. In the head 2, the opening extension portion Rb12 is located on the upper side of a second rib Rb2.

As well shown in FIG. 5, the first rib Rb1 continuously extends from one side of the opening 100 to another side of the opening 100. In the present embodiment, the first rib Rb1 continuously extends from the toe side of the opening 100 to the heel side of the opening 100. The first rib Rb1 intersects the opening 100. The opening extension portion Rb12 intersects the opening 100.

In a toe-side portion of the first rib Rb1, the first rib Rb1 extends from the body portion 110, through the support portion 102, to the upper side of the opening 100. Similarly, in a heel-side portion of the first rib Rb1, the first rib Rb1 extends from the body portion 110, through the support portion 102, to the upper side of the opening 100. The first rib Rb1 continuously extends from the body portion 110 on the one side of the opening 100 to the body portion 110 on the other side of the opening 100.

In the present disclosure, the "upper side" means an upper side in the vertical direction in a state where a head alone is stationarily placed on a horizontal plane.

The second member M2 covers the opening 100. It is sufficient that the second member M2 covers at least a part of the opening 100. In the present embodiment, the second member M2 covers the whole opening 100. The second member M2 constitutes a part of the sole 8. The position of the second member M2 is not limited. The second member M2 may be provided on the crown 6. The second member M2 may be provided on the side portion (skirt portion) of the head. The second member M2 may be provided on a region extending from the crown 6 to the sole 8.

The second member M2 includes the second rib Rb2. The second rib Rb2 is provided on the inner surface of the second member M2. The second rib Rb2 extends along the first rib Rb1. In the head 2, the second rib Rb2 is projected toward the hollow portion. The second rib Rb2 is projected upward.

As described above, the peripheral edge portion 250 of the second member M2 is disposed on the stepped-down portion 104 of the support portion 102. The second member M2 is adhered to the support portion 102 of the first member M1 by an adhesive.

[Composite Rib Rb: Engagement Between the First Rib Rb1 and the Second Rib Rb2]

As described above, the head 2 includes the composite rib Rb. The composite rib Rb is formed by combining the first rib Rb1 and the second rib Rb2.

The first rib Rb1 includes a receiving recess 120. As shown in FIG. 7, in the present embodiment, the receiving recess 120 is a slit. The second rib Rb2 is inserted to the receiving recess 120 (see enlarged portion in FIG. 4). The second rib Rb2 includes an insertion portion 200 inserted to the receiving recess 120. As shown in the enlarged portion in FIG. 4, in the present embodiment, an upper portion of the second rib Rb2 is the insertion portion 200. As a result of the insertion, the first rib Rb1 is engaged with the second rib Rb2. The first rib Rb1 is coupled to the second rib Rb2. The first rib Rb1 abuts the second rib Rb2. The first rib Rb1 supports the second rib Rb2.

Because of the engagement with the first rib Rb1, the second rib Rb2 is restrained by the first rib Rb1. As a result, the rigidity of the second member M2 is enhanced, whereby the rigidity of the head 2 is enhanced (rigidity enhancing effect). A high hitting sound can be obtained by the rigidity enhancing effect.

More preferably, the first rib Rb1 is adhered to the second rib Rb2 by an adhesive. Abutting portions between the first rib Rb1 and the second rib Rb2 are adhered to each other by the adhesive. The rigidity enhancing effect can be further increased by using the adhesion in addition to the engagement.

As shown in FIG. 6 and FIG. 7, the receiving recess 120 is provided on the opening extension portion Rb12. When the opening 100 is covered by the second member M2, the second rib Rb2 is inserted to the receiving recess 120, concomitantly. The second rib Rb2 is easily inserted to the receiving recess 120.

FIG. 5 is an exploded perspective view of the head 2. The receiving recess 120 is provided to extend over substantially the whole length of the opening extension portion Rb12. The whole length of the second rib Rb2 is inserted to the receiving recess 120.

Figure 8A:
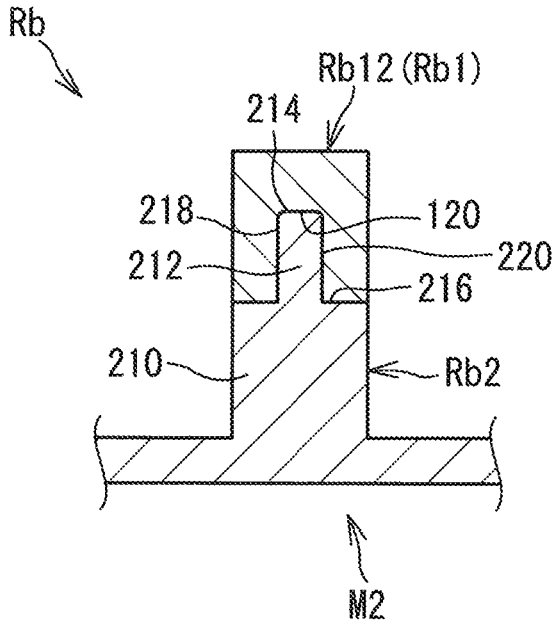
FIG. 8A and FIG. 8B are cross-sectional views of respective composite ribs according to modification examples of the first embodiment.
Figure 8B:
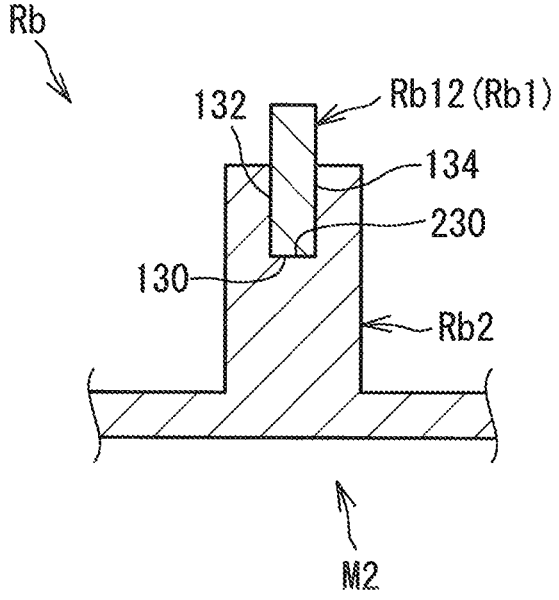

FIG. 8A and FIG. 8B are cross-sectional views showing modification examples of the engagement structure between the first rib Rb1 and the second rib Rb2 in the head 2. These drawings are cross-sectional views corresponding to the enlarged portion of FIG. 4.

In the composite rib Rb of FIG. 8A, the opening extension portion Rb12 is the same as that of the embodiment of FIG. 4. The second rib Rb2 includes a base portion 210 and a protruding portion 212 protruding upward from the base portion 210. The protruding portion 212 has a thickness smaller than that of the base portion 210.

Also in the present embodiment, the first rib Rb1 is engaged with the second rib Rb2. The protruding portion 212 is inserted to the receiving recess 120. An upper surface 214 of the protruding portion 212 abuts the first rib Rb1 (opening extension portion Rb12). Moreover, an upper surface 216 of the base portion 210 abuts the first rib Rb1. A side surface (front side surface) 218 of the second rib Rb2 (protruding portion 212) abuts the first rib Rb1 (opening extension portion Rb12). A side surface (back side surface) 220 of the second rib Rb2 (protruding portion 212) abuts the first rib Rb1 (opening extension portion Rb12). The second rib Rb2 is supported by the first rib Rb1 with these abutments.

Because of the engagement with the first rib Rb1, the second rib Rb2 is restrained by the first rib Rb1. As a result, the rigidity of the second member M2 is enhanced, whereby the rigidity of the head 2 is enhanced (rigidity enhancing effect).

In the embodiment of FIG. 8B, the opening extension portion Rb12 of the first rib Rb1 has a flat shape. In the present embodiment, the second rib Rb2 includes a receiving recess 230.

Also in the present embodiment, the first rib Rb1 is engaged with the second rib Rb2. The opening extension portion Rb12 is inserted to the receiving recess 230. A bottom surface 130 of the opening extension portion Rb12 abuts the second rib Rb2. Moreover, a side surface (front side surface) 132 of the first rib Rb1 (opening extension portion Rb12) abuts the second rib Rb2. A side surface (back side surface) 134 of the first rib Rb1 abuts the second rib Rb2. The second rib Rb2 is supported by the first rib Rb1.

Because of the engagement with the first rib Rb1, the second rib Rb2 is restrained by the first rib Rb1. As a result, the rigidity of the second member M2 is enhanced, whereby the rigidity of the head 2 is enhanced (rigidity enhancing effect).

Figure 9:
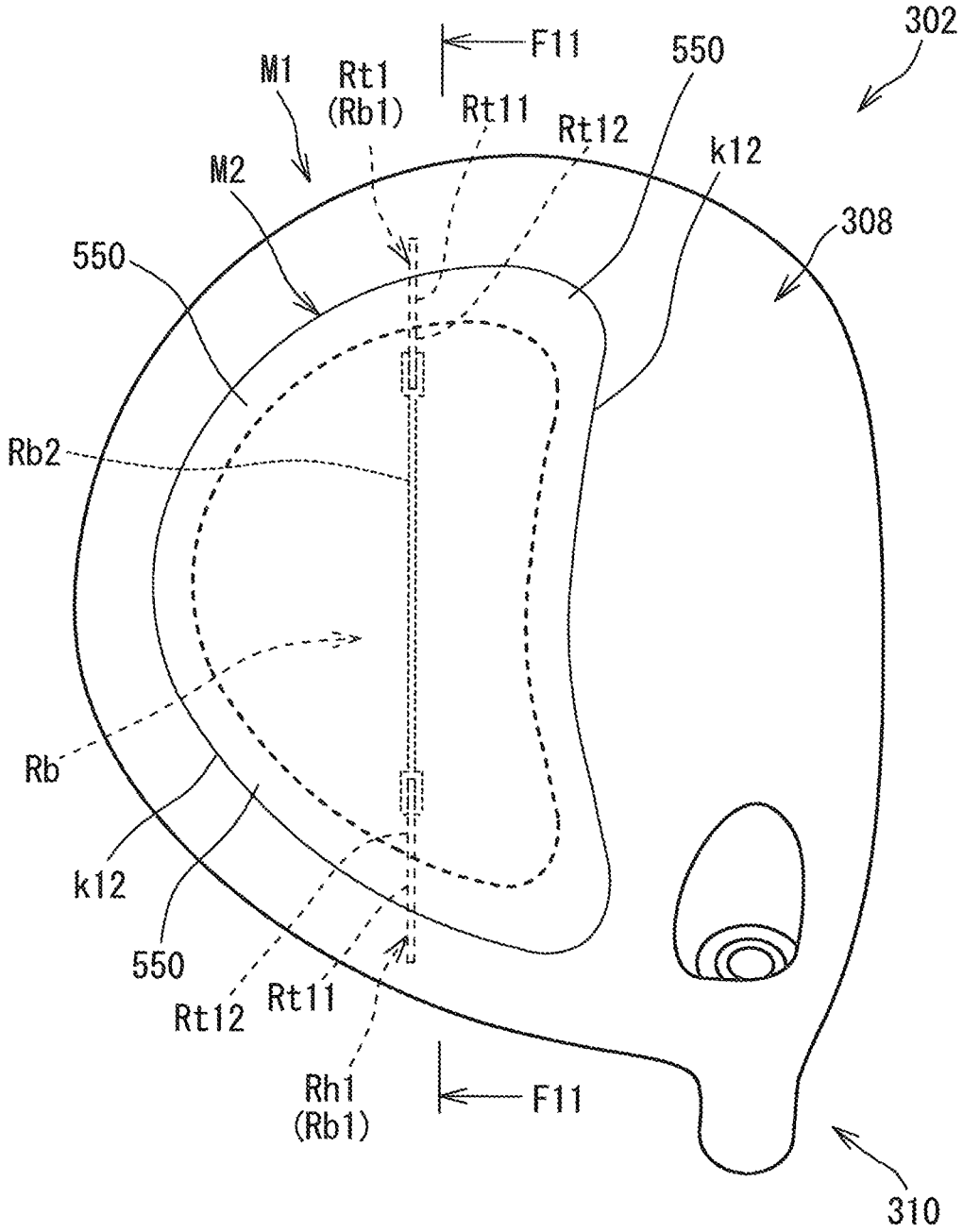
FIG. 9 is a bottom view of a head according to a second embodiment.
Figure 10:
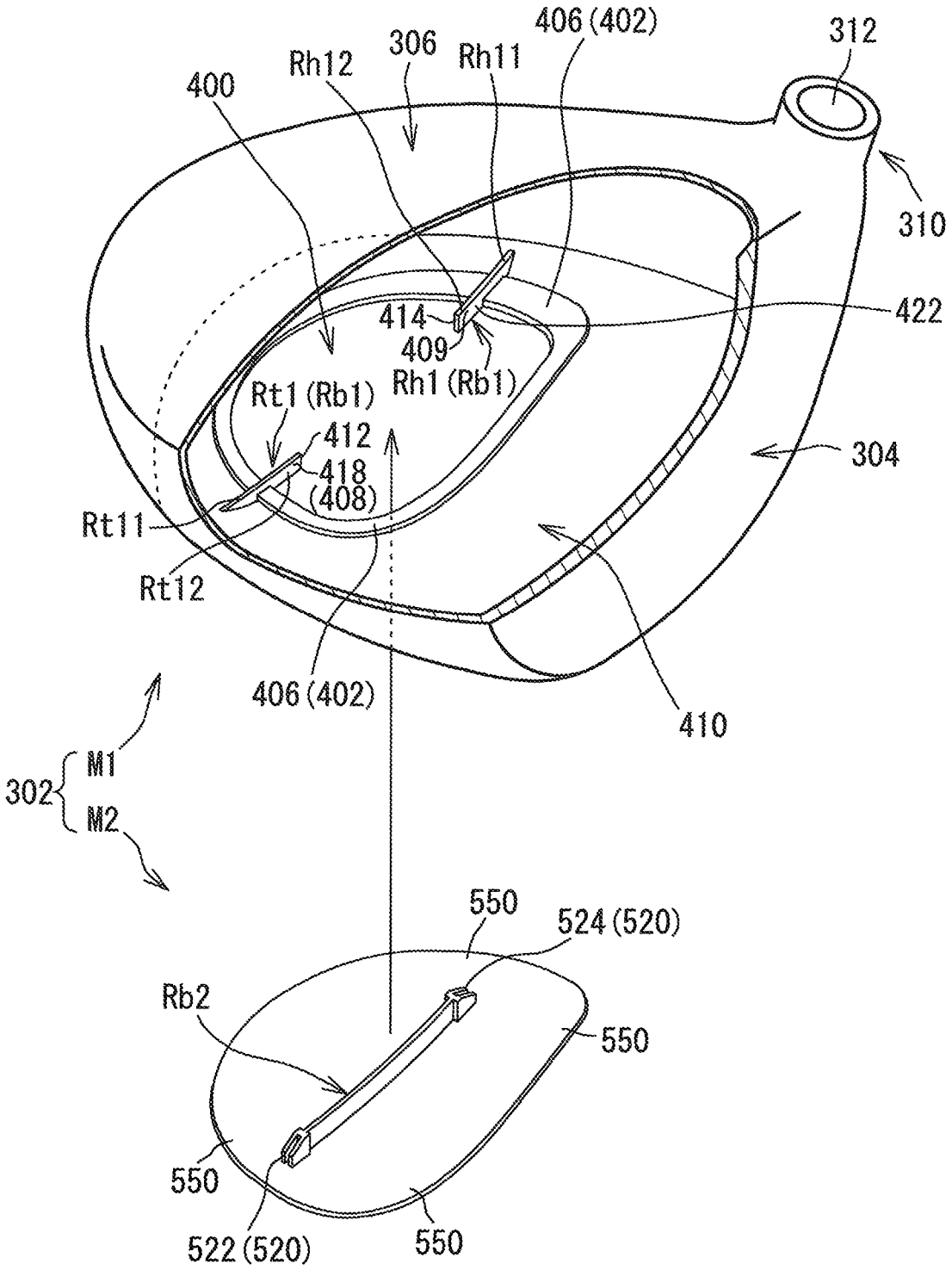
FIG. 10 is an exploded perspective view of the head in FIG. 9.
Figure 11:
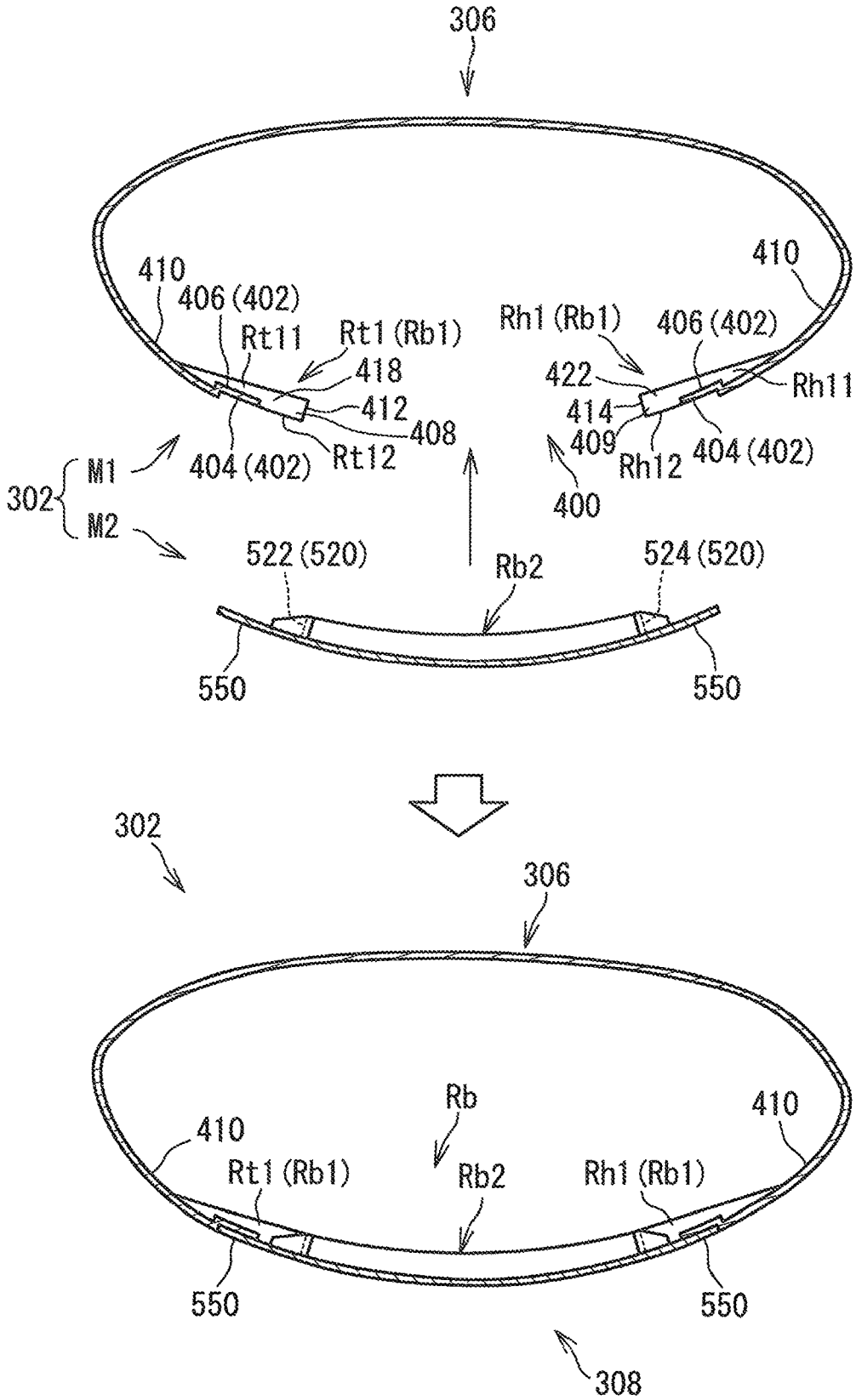
FIG. 11 is a cross-sectional view showing an assembling process of the head in FIG. 9.

FIG. 9 is a bottom view of a head 302 according to a second embodiment as viewed from the sole side. FIG. 10 is an exploded perspective view of the head 302. In the perspective view of the head in FIG. 10, a part of the head 302 is removed. FIG. 11 is a cross-sectional view showing an assembling process of the head 302. FIG. 11 is a cross-sectional view taken along line F11-F11 in FIG. 9.

The head 302 includes a hitting face 304, a crown 306, a sole 308, and a hosel 310. The hosel 310 includes a hosel hole 312. A shaft having a sleeve fixed to a tip end portion of the shaft is detachably fixed to the hosel hole 312. The head 302 includes a hollow portion.

The head 302 includes a composite rib Rb. The composite rib Rb is provided on the inner surface of the sole 308. The position of the composite rib Rb is not limited. For example, the composite rib Rb may be provided on the inner surface of the crown 306.

The head 302 is formed by joining a plurality of members. As shown in FIG. 10 and FIG. 11, the head 302 includes a first member M1 and a second member M2. The second member M2 constitutes a part of the sole 308. The first member M1 constitute the remaining portion of the head 302, which excludes the second member M2.

The second member M2 is joined to the first member M1. The joining method is an adhesion by an adhesive.

The first member M1 is a body of the head 302. The first member M1 constitutes the whole crown 306. The first member M1 constitutes the whole hitting face 304. The first member M1 constitutes the whole hosel 310. The first member M1 constitutes a part of the sole 308.

The first member M1 includes an opening 400. The opening 400 is provided in the sole 308. The opening 400 penetrates the sole 308. The opening 400 connects the hollow portion and the outside of the head 302.

As well shown in FIG. 10 and FIG. 11, the first member M1 includes a support portion 402. The support portion 402 is formed on the circumference of the opening 400. The support portion 402 surrounds the opening 400. The support portion 402 need not surrounds the opening 400. The support portion 402 may be provided partially on the circumference of the opening 400.

As well shown in FIG. 11, the support portion 402 forms a stepped-down portion 404 on the outer surface of the first member M1. In the present embodiment, the support portion 402 forms the stepped-down portion 404 on the outer surface of the sole 308. The stepped-down portion 404 has a contour shape corresponding to that of the second member M2. A peripheral edge portion 550 of the second member M2 is joined to the stepped-down portion 404 (see FIG. 11). This joining is adhesion using an adhesive. The stepped-down portion 404 has a depth corresponding to a thickness of the peripheral edge portion 550 of the second member M2. On the outer surface of the head 302, no step is present at a boundary k12 between the first member M1 and the second member M2.

As well shown in FIG. 10, the support portion 402 forms a stepped-up portion 406 on the inner surface of the first member M1. In the present embodiment, the support portion 402 forms the stepped-up portion 406 on the inner surface of the sole 308. The depth of the stepped-down portion 404 is equal to the height of the stepped-up portion 406. Of course, the depth of the stepped-down portion 404 need not be equal to the height of the stepped-up portion 406. The wall thickness of the support portion 402 may be equal to the wall thickness of the sole 308 in a portion adjacent to the support portion 402, or may be different from the wall thickness of the sole 308 in the portion adjacent to the support portion 402. For example, the wall thickness of the support portion 402 may be greater than the wall thickness of the sole 308 in the portion adjacent to the support portion 402.

As well shown in FIG. 10 and FIG. 11, the first member M1 includes the support portion 402 and a body portion 410 constituting the circumference of the support portion 402. The body portion 410 constitutes at least a portion adjacent to the support portion 402. In the present embodiment, of the first member M1, a portion excluding the support portion 402 is constituted by the body portion 410.

The first member M1 includes a first rib Rb1. The first rib Rb1 is divided in a longitudinal direction thereof. The first rib Rb1 is distributed to two locations. Unlike the embodiment of FIG. 5, the first rib Rb1 does not continuously extend from one side of the opening 400 to another side of the opening 400. The first rib Rb1 does not intersect the opening 400. The first rib Rb1 includes the first section Rt1 and a second section Rh1.

As well shown in FIG. 10, the first section Rt1 is disposed on one side of the opening 400. In the present embodiment, the first section Rt1 is disposed on the toe side of the opening 400. The second section Rh1 is disposed on another side of the opening 400. In the present embodiment, the second section Rh1 is disposed on the heel side of the opening 400.

Arrangement of the first section Rt1 and the second section Rh1 is not limited. For example, the first section Rt1 may be disposed on the face side of the opening 400, and the second section Rh1 may be disposed on the back side of the opening 400.

The first section Rt1 includes a base portion Rt11 and an opening extension portion Rt12. The base portion Rt11 is projected upward from the inner surface of the first member M1. The base portion Rt11 includes a portion located on the upper side of the body portion 410 and a portion located on the upper side of the support portion 402. The opening extension portion Rt12 is a portion extending on the upper side of the opening 400. The opening extension portion Rt12 extends from the base portion Rt11.

The second section Rh1 includes a base portion Rh11 and an opening extension portion Rh12. The base portion Rh11 is projected upward from the inner surface of the first member M1. The base portion Rh11 includes a portion located on the upper side of the body portion 410 and a portion located on the upper side of the support portion 402. The opening extension portion Rh12 is a portion extending on the upper side of the opening 400. The opening extension portion Rh12 extends from the base portion Rh11.

As well shown in FIG. 11, the first section Rt1 of the first rib Rb1 extends from the body portion 410, through the support portion 402, to the upper side of the opening 400. The first section Rt1 terminates at the upper side of the opening 400. An end face 412 of the first section Rt1 is located on the upper side of the opening 400. The second section Rh1 of the first rib Rb1 extends from the body portion 410, through the support portion 402, to the upper side of the opening 400. The second section Rh1 terminates at the upper side of the opening 400. An end face 414 of the second section Rh1 is located on the upper side of the opening 400.

The second member M2 covers the opening 400. The second member M2 constitutes a part of the sole 308.

The second member M2 includes a second rib Rb2. The second rib Rb2 is provided on the inner surface of the second member M2. In the head 302, the second rib Rb2 is projected toward the hollow portion. The second rib Rb2 is projected upward.

The peripheral edge portion 550 of the second member M2 is joined to the stepped-down portion 404 of the support portion 402. The second member M2 is adhered to the support portion 402 of the first member M1 by an adhesive.

[Composite Rib: Engagement Between the First Rib Rb1 and the Second Rib Rb2]

As described above, the head 302 includes the composite rib Rb. The composite rib Rb is formed by combining the first rib Rb1 with the second rib Rb2.

The second rib Rb2 includes a receiving recess 520. As shown in FIG. 10, in the present embodiment, the second rib Rb2 includes two receiving recesses 520. A first receiving recess 522 is provided at one end of the second rib Rb2. The first receiving recess 522 is a slit. A second receiving recess 524 is provided at the other end of the second rib Rb2. The second receiving recess 524 is a slit.

As well shown in FIG. 11, the first section Rt1 of the first rib Rb1 is inserted to the first receiving recess 522. By this insertion, the first section Rt1 is engaged with the second rib Rb2. Moreover, the second section Rh1 of the first rib Rb1 is inserted to the second receiving recess 524. By this insertion, the second section Rh1 is engaged with the second rib Rb2.

Thus, also in the present embodiment, the first rib Rb1 is engaged with the second rib Rb2. The first rib Rb1 is made continuous with the second rib Rb2. The first rib Rb1 abuts the second rib Rb2. The first rib Rb1 supports the second rib Rb2. The composite rib Rb is formed by the first section Rt1, the second section Rh1, and the second rib Rb2.

The second rib Rb2 is restrained by the first rib Rb1. As a result, the rigidity of the second member M2 is enhanced, whereby the rigidity of the head 302 is enhanced (rigidity enhancing effect). A high hitting sound can be obtained by the rigidity enhancing effect.

In the present embodiment, the first receiving recess 522 is provided at one side end of the second rib Rb2, and the one side end is engaged with the first section Rt1. Moreover, the second receiving recess 524 is provided at the other side end of the second rib Rb2, and the other side end is also engaged with the second section Rh1. The one side end and the other side end of the second rib Rb2 are engaged with the first rib Rb1.

More preferably, the first section Rt1 is adhered to the first receiving recess 522 by an adhesive. More preferably, the second section Rh1 is adhered to the second receiving recess 524 by an adhesive. The rigidity enhancing effect can be further increased by using the adhesion in addition to the engagement.

The opening extension portion Rt12 of the first section Rt1 is inserted to the first receiving recess 522. The opening extension portion Rt12 includes an insertion portion 408 inserted to the first receiving recess 522. The opening extension portion Rh12 of the second section Rh1 is inserted to the second receiving recess 524. When the opening 400 is covered by the second member M2, the first rib Rb1 (the first section Rt1, the second section Rh1) is inserted to the receiving recesses 520 (the first receiving recess 522, the second receiving recess 524), concomitantly. The first rib Rb1 can be easily engaged with the second rib Rb2.

Figure 12A:
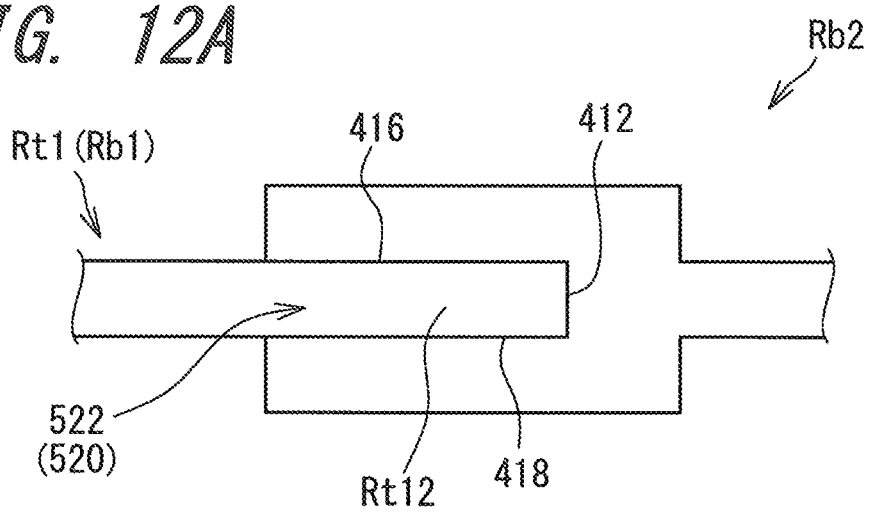
FIG. 12A and FIG. 12B are plan views showing engagement portions between ribs in the head of FIG. 9.
Figure 12B:
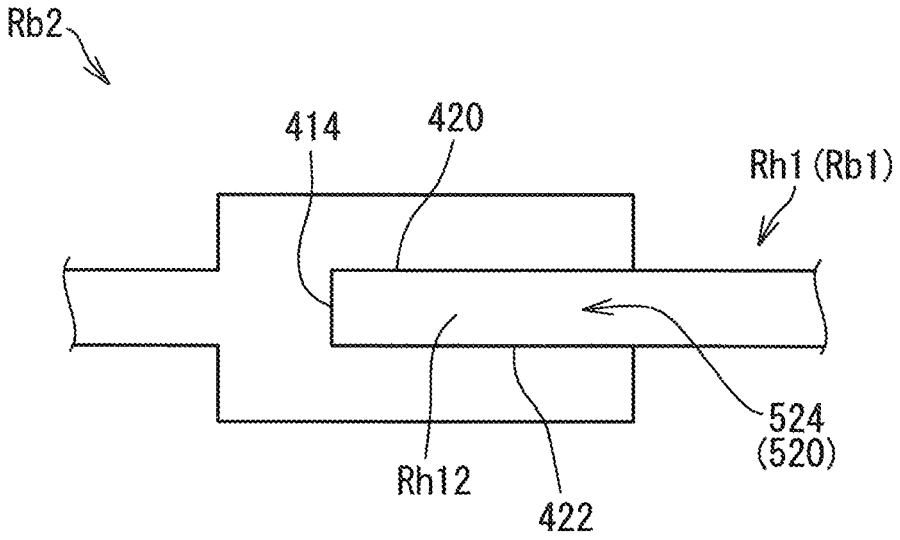

FIG. 12A is a plan view of an engagement portion between the first section Rt1 and the second rib Rb2 as viewed from above. FIG. 12B is a plan view of an engagement portion between the second section Rh1 and the second rib Rb2 as viewed from above.

With reference to FIG. 12A, as described above, the first section Rt1 of the first rib Rb1 is engaged with one end of the second rib Rb2. The opening extension portion Rh12 is inserted to the first receiving recess 522. The end face 412 of the first section Rt1 abuts the second rib Rb2. Aside surface (back side surface) 416 of the first section Rt1 abuts the second rib Rb2. A side surface (front side surface) 418 of the first section Rt1 abuts the second rib Rb2.

With reference to FIG. 12B, as described above, the second section Rh1 of the first rib Rb1 is engaged with the other end of the second rib Rb2. The opening extension portion Rh12 is inserted to the second receiving recess 524. The opening extension portion Rh12 includes an insertion portion 409 inserted to the second receiving recess 524. The end face 414 of the second section Rh1 abuts the second rib Rb2. A side surface (back side surface) 420 of the second section Rh1 abuts the second rib Rb2. A front side surface 422 of the second section Rh1 abuts the second rib Rb2. The second rib Rb2 is supported by the first rib Rb1.

The second rib Rb2 is restrained by the first rib Rb1. As a result, the rigidity of the second member M2 is enhanced, whereby the rigidity of the head 302 is enhanced (rigidity enhancing effect).

FIG. 13A to FIG. 13E are plan views of engagement portions between the first rib Rb1 and the second rib Rb2 as viewed from above. These are modification examples of the embodiment of FIG. 12A and FIG. 12B.

Figure 13A:
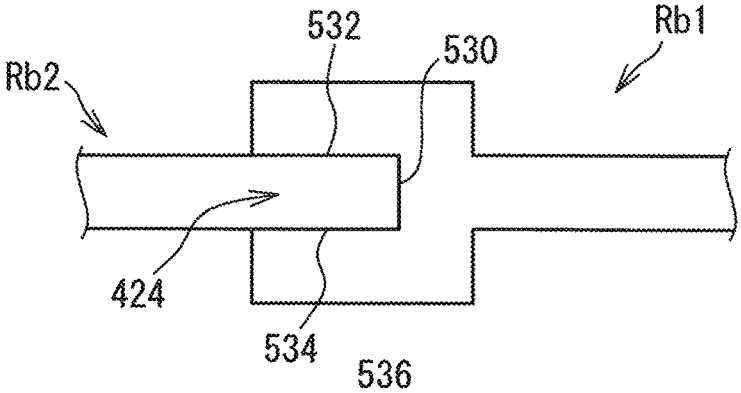
FIG. 13A to FIG. 13E are plan views showing modification examples of the engagement structure of ribs.

Contrary to the embodiment of FIG. 12A and FIG. 12B, in the embodiment of FIG. 13A, a receiving recess 424 is formed at an end of the first rib Rb1. One end of the second rib Rb2 is inserted to the receiving recess 424. An end face 530 of the second rib Rb2 abuts the first rib Rb1. Aside surface (back side surface) 532 of the second rib Rb2 abuts the first rib Rb1. A front side surface 534 of the second rib Rb2 abuts the first rib Rb1. This engagement is formed at both of one side end and the other side end of the second rib Rb2.

Figure 13B:
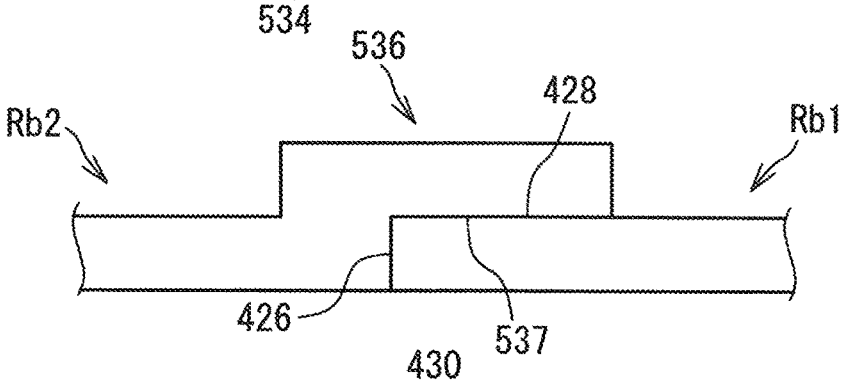

In the embodiment of FIG. 13B, a stepped portion 536 is formed at an end of the second rib Rb2. One end of the first rib Rb1 abuts the stepped portion 536. An end face 426 of the first rib Rb1 abuts the second rib Rb2. A side surface 428 of the first rib Rb1 abuts a side surface 537 of the second rib Rb2. This engagement is formed at both of one side end and the other side end of the second rib Rb2.

Figure 13C:
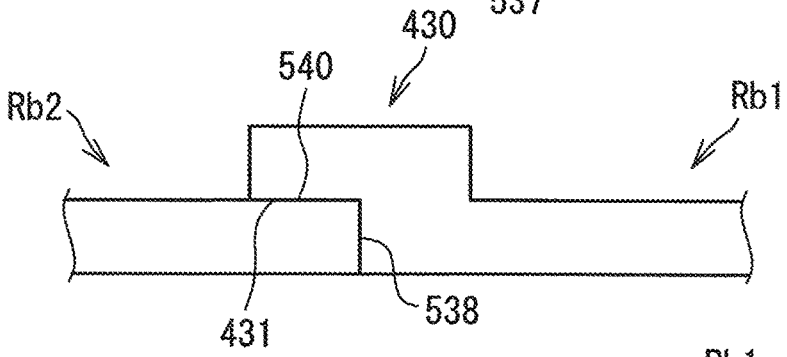

Contrary to the embodiment of FIG. 13B, in the embodiment of FIG. 13C, a stepped portion 430 is formed at an end of the first rib Rb1. One end of the second rib Rb2 abuts the stepped portion 430. An end face 538 of the second rib Rb2 abuts the first rib Rb1. A side surface 540 of the second rib Rb2 abuts a side surface 431 of the first rib Rb1. This engagement is formed at both of one side end and the other side end of the second rib Rb2.

Figure 13D:
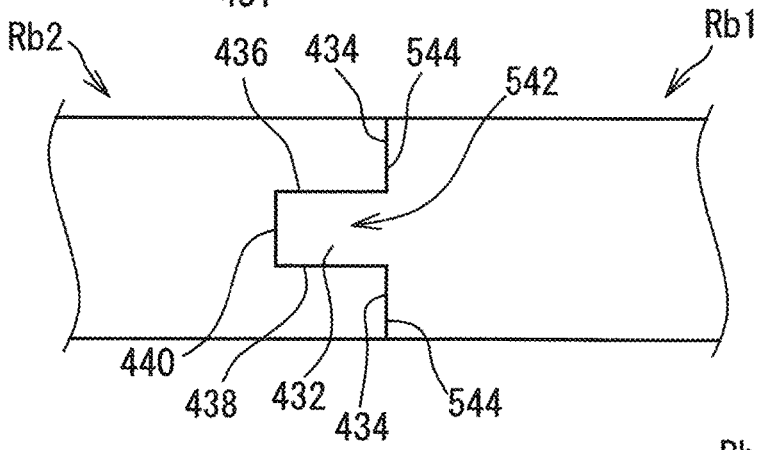

In the embodiment of FIG. 13D, the second rib Rb2 includes a receiving recess 542. The receiving recess 542 is formed on an end face 544 of the second rib Rb2. The first rib Rb1 includes a projection 432. The projection 432 is formed on an end face 434 of the first rib Rb1. The projection 432 of the first rib Rb1 is inserted to the receiving recess 542. The end face 434 of the first rib Rb1 abuts the end face 544 of the second rib Rb2. A side surface (back side surface) 436 of the first rib Rb1 abuts the second rib Rb2. A side surface (front side surface) 438 of the first rib Rb1 abuts the second rib Rb2. A tip end face 440 of the projection 432 abuts the second rib Rb2. This engagement is formed at both of one side end and the other side end of the second rib Rb2.

Figure 13E:
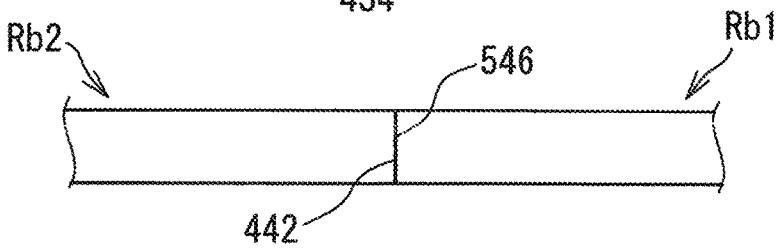

In the embodiment of FIG. 13E, an end face 442 of the first rib Rb1 abuts an end face 546 of the second rib Rb2. In this embodiment, the end face 442 of the first rib Rb1 and the end face 546 of the second rib Rb2 abut against each other. Such a simple abutment between ribs is also included in the concept of "engagement" in the present disclosure.

Also in the embodiments of FIG. 13A to FIG. 13E, the first rib Rb1 is engaged with the second rib Rb2. In these embodiments, the second rib Rb2 is restrained by the first rib Rb1. As a result, the rigidity of the second member M2 is enhanced, whereby the rigidity of the head 2 is enhanced (rigidity enhancing effect).

Figure 14A:
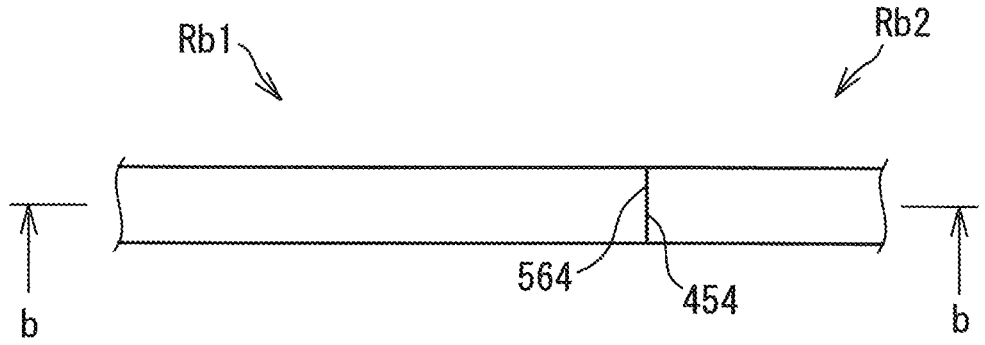
FIG. 14A is a plan view showing a modification example of the engagement structure of ribs in the second embodiment.
Figure 14B:
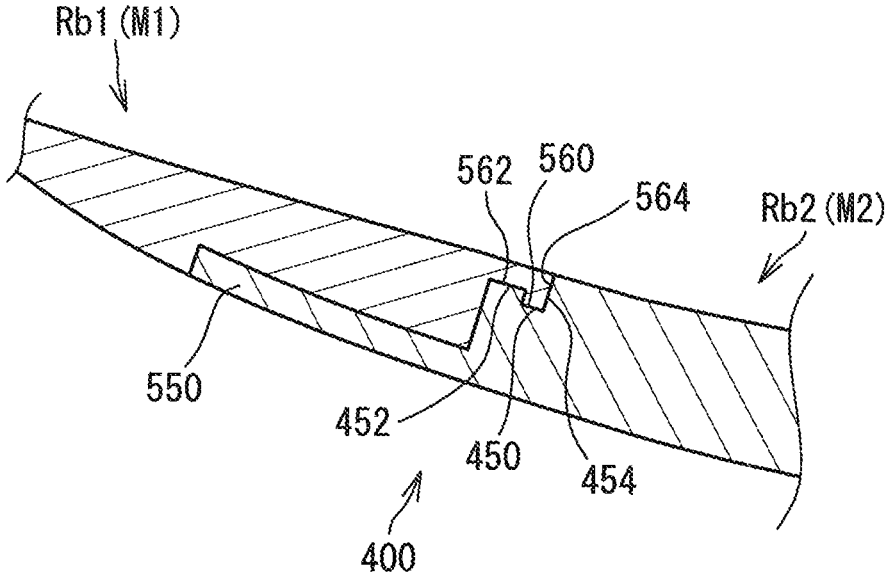
FIG. 14B is a cross-sectional view taken along line b-b in FIG. 14A.

FIG. 14A and FIG. 14B are also a modification example of the embodiment of FIG. 12A and FIG. 12B. FIG. 14A is a plan view as viewed from above, and FIG. 14B is a cross-sectional view taken along line b-b in FIG. 14A.

An end face 454 of the first rib Rb1 abuts an end face 564 of the second rib Rb2.

The first rib Rb1 includes a projection 450 projected toward the sole side. The second rib Rb2 includes a recess 560 receiving the projection 450. The projection 450 is engaged with the recess 560 to achieve the engagement between the first rib Rb1 and the second rib Rb2.

The second rib Rb2 includes a projection 562 projected toward the crown side. The first rib Rb1 includes a recess 452 receiving the projection 562. The projection 562 is engaged with the recess 452 to achieve the engagement between the first rib Rb1 and the second rib Rb2.

When the second member M2 is disposed on the opening 400 of the first member M1, the projection 450 is received by the recess 560, concomitantly. When the second member M2 is disposed on the opening 400 of the first member M1, the projection 562 is received by the recess 452, concomitantly. Therefore, the second member M2 is easily attached to the opening 400.

Also in the embodiment of FIG. 14A and FIG. 14B, the first rib Rb1 is engaged with the second rib Rb2. The second rib Rb2 is restrained by the first rib Rb1. The rigidity of the second member M2 is enhanced, whereby the rigidity of the head is enhanced (rigidity enhancing effect).

Figure 15:
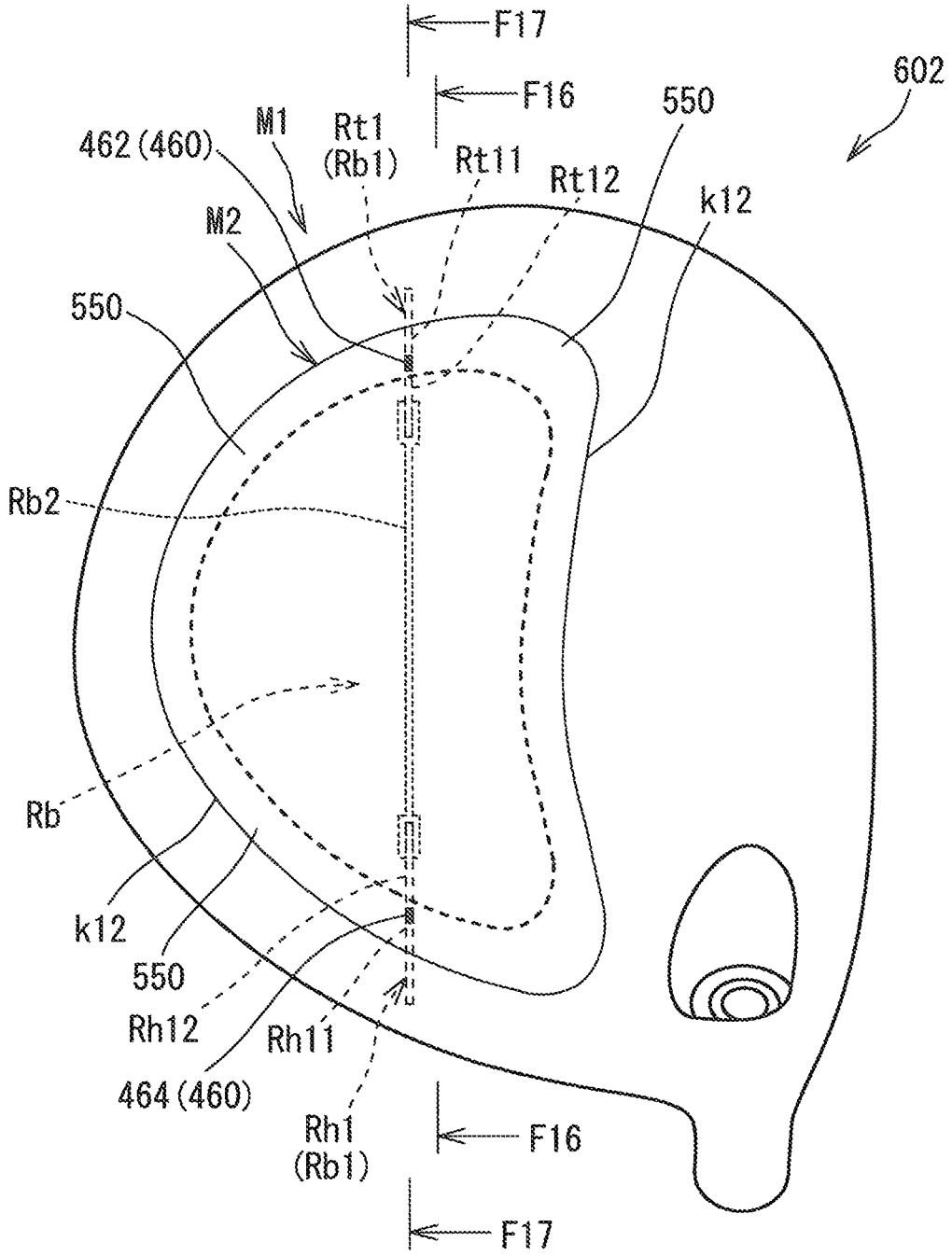
FIG. 15 is a bottom view of a head according to a third embodiment.
Figure 16:
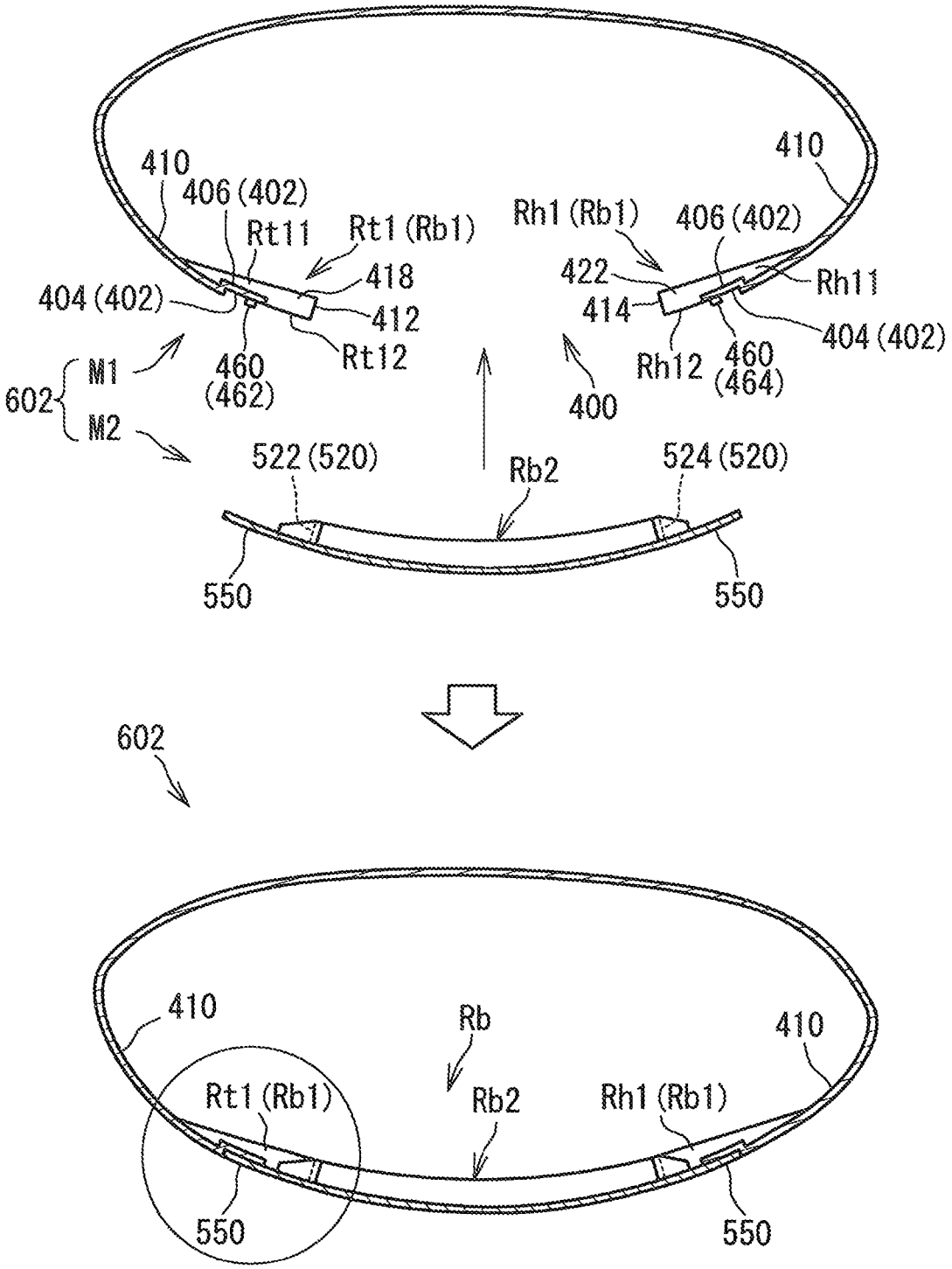
FIG. 16 is a cross-sectional view showing an assembling process of the head in FIG. 15.
Figure 17:
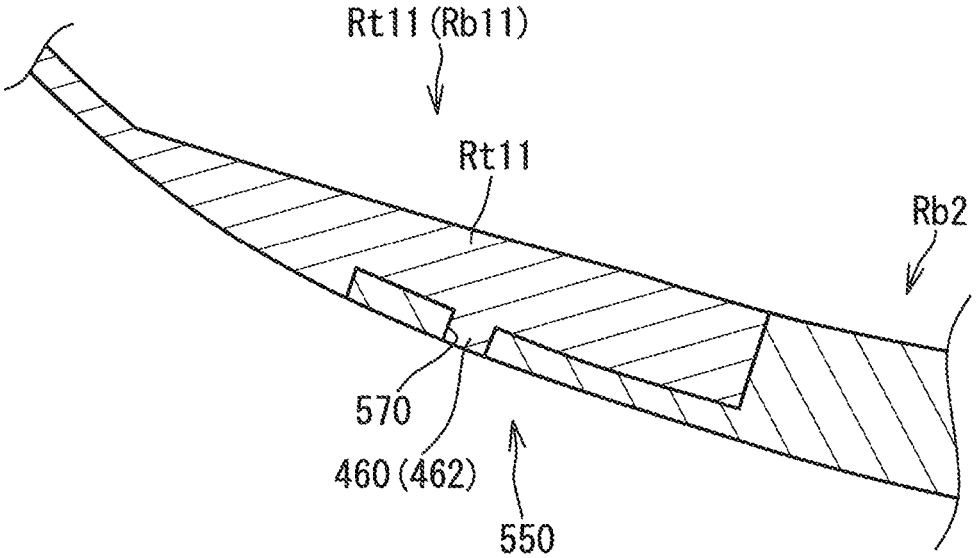
FIG. 17 is a cross-sectional view taken along line F17-F17 in FIG. 15.

FIG. 15 shows a head 602, which is a modification example of the head 302. FIG. 15 is a bottom view of the head 602 as viewed from the sole side. FIG. 16 is a cross-sectional view showing an assembling process of the head 602. FIG. 17 is an enlarged view within the circle of FIG. 16. Note that the position of the cross-sectional line of FIG. 16 is different from that of FIG. 17. FIG. 16 is a cross-sectional view taken along line F16-F16 in FIG. 15. FIG. 17 is a cross-sectional view taken along line F17-F17 in FIG. 15.

As shown in the cross-sectional view of the first member M1 in FIG. 16, the first member M1 includes an engaging projection 460. The engaging projection 460 is provided on the support portion 402. The engaging projection 460 is provided on the stepped-down portion 404 of the support portion 402. The engaging projection 460 is projected toward the sole surface. The engaging projection 460 is provided on the lower side of the first rib Rb1.

In the head 602, two engaging projections 460 are provided. A first engaging projection 462 is provided on the lower side of the first section Rt1. The first engaging projection 462 is provided on the lower side of the base portion Rt11. A second engaging projection 464 is provided on the lower side of the second section Rh1. The second engaging projection 464 is provided on the lower side of the base portion Rh11.

Although not shown in FIG. 16, as shown in FIG. 17, the second member M2 includes a hole 570 engaged with the engaging projection 460. The hole 570 is provided on the peripheral edge portion 550 of the second member M2. The hole 570 is provided at a position corresponding to the engaging projection 460. Two holes 570 are provided. The engaging projections 460 are engaged with (fitted to) the respective holes 570. In the present embodiment, the holes 570 are through holes. For this reason, end faces of the engaging projections 460 are exposed to the outside. The end faces of the engaging projections 460 are shown with solid black in FIG. 15.

Except for the presence of the engaging projections 460 and the holes 570, the head 602 is the same as the head 302.

The engagement between the first rib Rb1 and the second rib Rb2 is further securely maintained by the engagement between the engaging projections 460 and the holes 570. Moreover, joining strength between the peripheral edge portion 550 of the second member M2 and the support portion 402 of the first member M1 is enhanced by using such a physical engagement in addition to the adhesion by an adhesive.

As described above, the rigidity enhancing effect is exhibited by the engagement between the first rib Rb1 and the second rib Rb2.

In the head 2 of the first embodiment, the first rib Rb1 intersects the opening 100 (see FIG. 5). For this reason, the area of the engagement between the first rib Rb1 and the second rib Rb2 can be made longer. In case of the head 2, the whole length of the second rib Rb2 is engaged with the first rib Rb1. This long first rib Rb1 enlarges the restraint laid on the second rib Rb2, and increases the rigidity enhancing effect.

When the first rib Rb1 intersects the opening 100, the first rib Rb1 itself can effectively suppress deterioration in rigidity of the first member M1 due to the presence of the opening 100. This effect is combined with the rigidity enhancing effect brought by the engagement between ribs, whereby the rigidity of the head 2 can be enhanced.

In the head 302 according to the second embodiment, the first rib Rb1 is distributed to one side and another side of the opening 400 (see FIG. 10). For this reason, weight reduction of the first rib Rb1 is achieved. Moreover, since the first ribs Rb1 are engaged with both ends of the second rib Rb2, the second rib Rb2 is effectively restrained. The head 302 is also excellent in the rigidity enhancing effect.

In the head 302, although the first rib Rb1 does not intersect the opening 400, the composite rib Rb intersects the opening 400. That is, also in the head 302, the composite rib Rb continuously extends from one side of the opening 400 to the other side of the opening 400. The composite rib Rb can effectively reinforce the rigidity of the first member M1 to prevent deterioration of the rigidity due to the presence of the opening 400.

In a hollow head, the outer shell of the head is vibrated to produce a big hitting sound. For example, vibration of the sole produces a vibration mode in such a manner that the center portion of the sole is the antinode of the vibration.

The vibration can cause the second rib Rb2 to be deformed or displaced in such a manner that the side surfaces thereof are inclined. Similarly, the vibration can cause the first rib Rb1 to be deformed or displaced in such a manner that the side surfaces thereof are inclined. These deformations or displacements are suppressed because at least one side surface of the first rib Rb1 and the second rib Rb2 abuts on the other rib. As a result, the above-mentioned vibration is suppressed, whereby the hitting sound can be improved.

The vibration can cause the second rib Rb2 to be deformed or displaced in such a manner that the end face thereof is inclined. Similarly, the vibration can cause the first rib Rb1 to be deformed or displaced such that the end face thereof is inclined. These deformations or displacements are suppressed because at least one end face of the first rib Rb1 and the second rib Rb2 abuts on the other rib. As a result, the above-mentioned vibration is suppressed, whereby the hitting sound can be improved.

In both the first embodiment (FIG. 5) and the second embodiment (FIG. 10), the first rib Rb1 extends from the body portion of the first member M1, through the support portion of the first member M1, to the upper side of the opening. That is, the first rib Rb1 is laid across the support portion. If the first rib Rb1 does not extend from the body portion of the first member M1 and the first rib Rb1 extends from the support portion of the first member M1 to the upper side of the opening, the rigidity in the vicinity of the support portion can deteriorate. Since the first rib Rb1 is laid across the support portion, the rigidity in the vicinity of the support portion is enhanced. For this reason, deterioration in rigidity of the first member M1 due to the presence of the opening is suppressed. Moreover, the deformation and displacement of the first rib Rb1 are also suppressed by enhancing the rigidity in the vicinity of the support portion. As a result, the second rib Rb2 is securely restrained by the first rib Rb1.

A double-pointed arrow HR in the enlarged portion of FIG. 4 shows a rib height of the second rib Rb2. A double-pointed arrow BR in the enlarged portion of FIG. 4 shows a rib width of the second rib Rb2. A double-pointed arrow FR in the enlarged portion of FIG. 4 shows a height of the composite rib. A double-pointed arrow WR in the enlarged portion of FIG. 4 shows a width of the composite rib.

When a rib height in the base portion Rb11 of the first rib Rb1 is excessively large, the opening extension portion Rb12 extending from the base portion Rb11 might become likely to vibrate. In this respect, the maximum value of the rib height in the base portion Rb11 of the first rib Rb1 is preferably less than or equal to 12 mm, more preferably less than or equal to 10 mm, and still more preferably less than or equal to 8 mm. When the rib height in the base portion Rb11 of the first rib Rb1 is excessively small, the degree of freedom in design of the opening extension portion Rb12 extending from the base portion Rb11 is reduced. In this respect, the maximum value of the rib height in the base portion Rb11 of the first rib Rb1 is preferably greater than or equal to 2 mm, more preferably greater than or equal to 3 mm, and still more preferably greater than or equal to 4 mm. Note that the "maximum value" is set for considering that the rib height of the first rib Rb1 can vary.

When a rib width in the base portion Rb11 of the first rib Rb1 is excessively large, weights of the first rib Rb1 and the composite rib Rb become excessively large, whereby the degree of freedom in design of the head can be reduced. In this respect, the maximum value of the rib width in the base portion Rb11 of the first rib Rb1 is preferably less than or equal to 5 mm, more preferably less than or equal to 4 mm, and still more preferably less than or equal to 3 mm. When the rib width in the base portion Rb11 of the first rib Rb1 is excessively small, the effect of the restraint laid on the second rib Rb2 can be reduced. In this respect, the maximum value of the rib width in the base portion Rb11 of the first rib Rb1 is preferably greater than or equal to 1 mm, more preferably greater than or equal to 1.2 mm, and still more preferably greater than or equal to 1.5 mm. Note that the "maximum value" is set for considering that the rib width of the first rib Rb1 can vary.

When the rib height HR of the second rib Rb2 is excessively large, weights of the second rib Rb2 and the composite rib Rb become excessively large, whereby the degree of freedom in design of the head can be reduced. In this respect, the maximum value of the height HR of the second rib Rb2 is preferably less than or equal to 12 mm, more preferably less than or equal to 10 mm, and still more preferably less than or equal to 8 mm. When the height HR of the second rib Rb2 is excessively small, the degree of freedom in the engagement structure with the first rib Rb1 can be reduced. In this respect, the maximum value of the height HR of the second rib Rb2 is preferably greater than or equal to 2 mm, more preferably greater than or equal to 3 mm, and still more preferably greater than or equal to 4 mm. Note that the "maximum value" is set for considering that the height HR of the second rib Rb2 can vary.

When the width BR of the second rib Rb2 is excessively large, weights of the second rib Rb2 and the composite rib Rb become excessively large, whereby the degree of freedom in design of the head is reduced. In this respect, the maximum value of the width BR of the second rib Rb2 is preferably less than or equal to 5 mm, and more preferably less than or equal to 4 mm, and still more preferably less than or equal to 3 mm. When the rib width BR of the second rib Rb2 is excessively small, the effect of enhancing the rigidity of the second member M2 can be reduced. In this respect, the maximum value of the width BR of the second rib Rb2 is preferably greater than or equal to 1 mm, more preferably greater than or equal to 1.2 mm, and still more preferably greater than or equal to 1.5 mm. Note that the "maximum value" is set for considering that the width BR of the second rib Rb2 can vary.

When the height FR of the composite rib Rb is excessively large, the weight of the composite rib Rb becomes excessively large, whereby the degree of freedom in design of the head can be reduced. In this respect, the maximum value of the height FR of the composite rib Rb is preferably less than or equal to 15 mm, more preferably less than or equal to 12 mm, and still more preferably less than or equal to 10 mm. When the height FR of the composite rib Rb is excessively small, the rigidity enhancing effect can be reduced. Moreover, when the height FR is excessively small, the degree of freedom in the engagement structure between the first rib Rb1 and the second rib Rb2 can be reduced. In these respects, the maximum value of the height FR of the composite rib Rb is preferably greater than or equal to 3 mm, more preferably greater than or equal to 4 mm, and still more preferably greater than or equal to 5 mm. Note that the "maximum value" is set for considering that the height FR of the composite rib Rb can vary.

When the width WR of the composite rib Rb is excessively large, the weight of the composite rib Rb becomes excessively large, whereby the degree of freedom in design of the head can be reduced. In this respect, the maximum value of the width WR of the composite rib Rb is preferably less than or equal to 8 mm, and more preferably less than or equal to 7 mm, and still more preferably less than or equal to 6 mm. When the width WR of the composite rib Rb is excessively small, the rigidity enhancing effect can be reduced. Moreover, when the width WR is excessively small, the degree of freedom in the engagement structure between the first rib Rb1 and the second rib Rb2 can be reduced. In these respects, the maximum value of the width WR of the composite rib Rb is preferably greater than or equal to 2 mm, more preferably greater than or equal to 2.5 mm, and still more preferably greater than or equal to 3 mm. Note that the "maximum value" is set for considering that the width WR of the composite rib Rb can vary.

It is preferable that the second member M2 is formed by a material having a Young's modulus of smaller than that of the material of the first member M1. The rigidity of the second member M2 having a smaller Young's modulus can be effectively enhanced by engaging the second rib Rb2 with the first rib Rb1 of the first member M1 having a greater Young's modulus.

Examples of the material of the second member M2 include a metal and a resin. The resin includes a fiber reinforced resin. In view of the degree of freedom in design of the head, a material that is lightweight and excellent in strength is preferable. In this respect, the fiber reinforced resin is preferable, and a carbon fiber reinforced resin is more preferable. Examples of the metal include iron, stainless steel, a titanium alloy, an aluminum alloy, and a magnesium alloy.

The material of the second rib Rb2 may be the same as the material of a main portion of the second member M2, or may be different from the material of the main portion of the second member M2. The main portion of the second member M2 means, of second member M2, a portion excluding the second rib Rb2. In light of fixing strength of the second rib Rb2 to the main portion, the material of the second rib Rb2 is preferably the same as the material of the main portion of the second member M2.

Examples of the material of the first member M1 include a metal and a resin. In light of hitting sound, the metal is preferable. Examples of the metal include iron, stainless steel, a titanium alloy, an aluminum alloy, and a magnesium alloy. In light of formability and strength, the stainless steel and the titanium alloy are preferable.

The material of the first rib Rb1 may be the same as the material of the body portion of the first member M1, or may be different from the material of the body portion of the first member M1. In light of fixing strength of the first rib Rb1 to the body portion, the material of the first rib Rb1 is preferably the same as the material of the body portion of the first member M1.

Values of Young's moduli for commonly used materials are known. Magnitude relationship between the Young's modulus of the first member M1 and the Young's modulus of the second member M2 can be determined based on the known values. When the Young's modulus of a certain material is unknown, or magnitude relationship between the two Young's moduli is unclear, those Young's moduli can be determined by the following measurement method.

Figure 18:
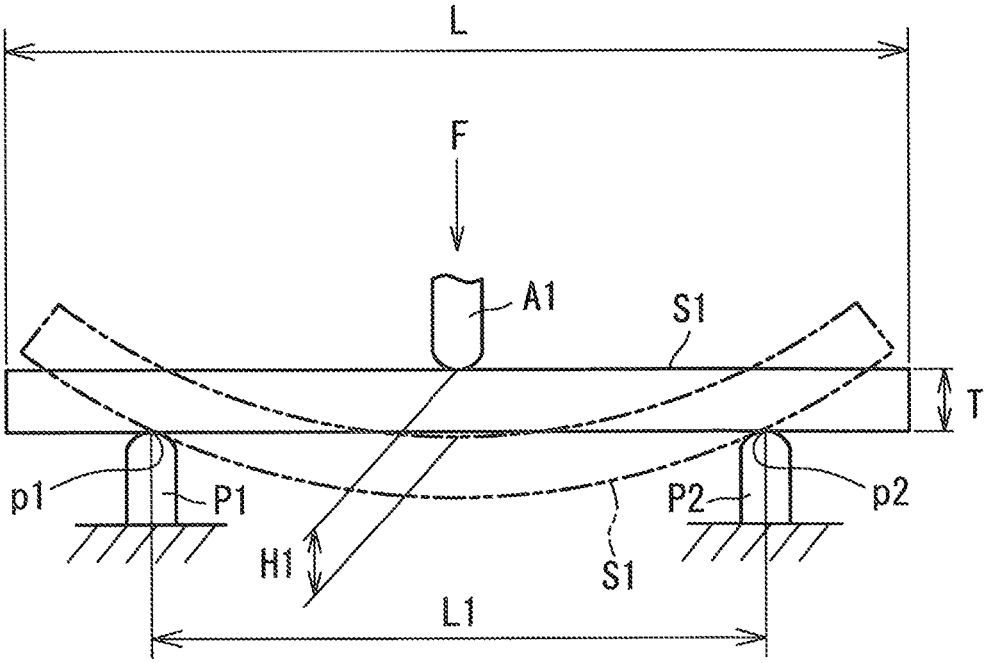
FIG. 18 is a schematic diagram showing a method for measuring a Young's modulus.

FIG. 18 is a schematic view showing a measurement method of Young's modulus. No. 3 test piece according to bend test pieces for metallic materials in JIS 22204 is used in this measurement as a test piece S1. The test piece S1 has a cross-sectional shape of a rectangle. The test piece S1 has dimensions of 20 mm in width W (not shown), and 3.0 mm in thickness T. The test piece S1 has a length L of 150 mm. The test piece S1 is placed on two supports P1 and P2 arranged so as to have a span L1 between the two supports of 30 mm. The test piece S1 is laid horizontally. A bending amount H1 (mm) is measured when a load F (N) is applied to a position dividing the distance between support points p1 and p2 into two equal parts. The load F is 100N. The load F is applied with an indenter A1. As a testing device, "Intesco (load cell 2 tons)" produced by Intesco Co., Ltd.

can be used. The measurement is performed in compliance with JIS 22248. Young's modulus Yg (GPa) is calculated by the following formula.

$$Yg=[(L1^3\times F)/(4\times W\times T^3\times H1)]\times 10^{-3}$$

The Young's modulus of a material that cannot be measured by the above method can be measured by a flexural resonance method. In the flexural resonance method, a test piece having dimensions of 10 mm×60 mm×2 mm is used, and the Young's modulus can be measured at 20° C.

When the material has anisotropy, the test piece is prepared such that the Young's modulus is the maximum.

The second member M2 is preferably adhered to the first member M1 by an adhesive. When an adhesive is used, hitting sound is likely to lower. Therefore, in this case, the effect of improvement in hitting sound brought by the rigidity enhancing effect is enhanced.

As to the above-described embodiments, the following clauses are disclosed.

[Clause 1]

A golf club head including a hollow portion, wherein the golf club head further includes a first member having an opening, and a second member attached to the first member and covering the opening, the first member includes a first rib projected toward the hollow portion, the second member includes a second rib projected toward the hollow portion, and the first rib is engaged with the second rib.

[Clause 2]

The golf club head according to clause 1, wherein a Young's modulus of a material of the second member is smaller than a Young's modulus of a material of the first member.

[Clause 3]

The golf club head according to clause 1 or 2, wherein the second member is adhered to the first member using an adhesive.

[Clause 4]

The golf club head according to any one of clauses 1 to 3, wherein one of the first rib and the second rib includes a receiving recess, and the other of the first rib and the second rib includes an insertion portion inserted to the receiving recess.

[Clause 5]

The golf club head according to any one of clauses 1 to 4, wherein at least one of the first rib and the second rib includes an end face, and the end face abuts the other of the first rib and the second rib.

[Clause 6]

The golf club head according to any one of clauses 1 to 5, wherein at least one of the first rib and the second rib includes a side surface, and the side surface abuts the other of the first rib and the second rib.

[Clause 7]

The golf club head according to any one of clauses 1 to 6, wherein the first rib includes an opening extension portion extending on an upper side of the opening, and the opening extension portion is engaged with the second rib.

[Clause 8]

The golf club head according to any one of clauses 1 to 7, wherein the first member includes a support portion formed on a circumference of the opening and forming a stepped-down portion on an outer surface of the first member, and a body portion constituting a circumference of the support portion, the second member includes a peripheral edge portion that is joined to the support portion, and the first rib extends from the body portion, through the support portion, to an upper side of the opening.

[Clause 9]

The golf club head according to any one of clauses 1 to 8, wherein the first rib includes a first section disposed on one side of the opening, and a second section disposed on another side of the opening, the second rib has one side end that is engaged with the first section, and the second rib has the other side end that is engaged with the second section.

[Clause 10]

The golf club head according to any one of clauses 1 to 8, wherein the first rib continuously extends from one side of the opening to another side of the opening.

The above description is merely illustrative example, and various modifications can be made.

What is claimed is:

1. A golf club head comprising a hollow portion, wherein the golf club head further comprises a first member including an opening, and a second member attached to the first member and covering the opening, the first member includes a first rib projected toward the hollow portion and having a first length extending beyond the opening, the second member includes a second rib projected toward the hollow portion and having a second length contained within the opening, the first rib is engaged with the second rib to form a composite rib extending across the opening to thereby traverse and divide the opening into two portions, and the composite rib intersects the opening.

2. The golf club head according to claim 1, wherein a Young's modulus of a material of the second member is smaller than a Young's modulus of a material of the first member.

3. The golf club head according to claim 1, wherein the second member is adhered to the first member by an adhesive.

4. The golf club head according to claim 1, wherein one of the first rib and the second rib includes a receiving recess, and the other of the first rib and the second rib includes an insertion portion inserted to the receiving recess.

5. The golf club head according to claim 1, wherein at least one of the first rib and the second rib includes an end face, and the end face abuts the other of the first rib and the second rib.

6. The golf club head according to claim 1, wherein at least one of the first rib and the second rib includes a side surface, and the side surface abuts the other of the first rib and the second rib.

7. The golf club head according to claim 1, wherein the first rib includes an opening extension portion extending on an upper side of the opening, and the opening extension portion is engaged with the second rib.

8. The golf club head according to claim 1, wherein the first member includes a support portion formed on a circumference of the opening and forming a stepped-down portion on an outer surface of the first member, and a body portion constituting a circumference of the support portion, the second member includes a peripheral edge portion that is joined to the support portion, and the first rib extends from the body portion, through the support portion, to an upper side of the opening.

9. The golf club head according to claim 1, wherein the first rib includes a first section disposed on one side of the opening, and a second section disposed on another side of the opening, the second rib has one side end and other side end, the one side end is engaged with the first section, and the other side end is engaged with the second section.

10. The golf club head according to claim 1, wherein the first rib continuously extends from one side of the opening to another side of the opening.

11. The golf club head according to claim 1, wherein the golf club head further includes a hitting face, a crown, a sole, and a hosel, and the first member includes at least a part of the crown, at least a part of the hitting face, at least a part of the sole, and at least a part of the hosel.

12. The golf club head according to claim 1, wherein the first member is made of a metal, and the second member is made of a fiber reinforced resin.

13. The golf club head according to claim 1, wherein the second rib includes two ends, and the first rib is engaged with at least the two ends of the second rib.

14. The golf club head according to claim 1, wherein the composite rib continuously extends from one side of the opening to another side of the opening.

15. A golf club head comprising a hollow portion, wherein the golf club head further comprises a first member including an opening, and a second member attached to the first member and covering the opening, the first member includes a first rib projected toward the hollow portion, the second member includes a second rib projected toward the hollow portion, the first rib is engaged with the second rib, the first member includes a support portion formed on a circumference of the opening and forming a stepped-down portion on an outer surface of the first member, and a body portion constituting a circumference of the support portion, the second member includes a peripheral edge portion that is joined to the support portion, and the first rib extends from the body portion, through the support portion, to an upper side of the opening.

* * * * *